US005177522A

United States Patent [19]

Hayashi

[11] Patent Number: 5,177,522

[45] Date of Patent: Jan. 5, 1993

[54] APPARATUS FOR PROCESSING LIGHT-SENSITIVE MATERIALS

[75] Inventor: Hiroshi Hayashi, Kanagawa, Japan

[73] Assignee: Fuji Photo Film Co., Ltd., Kanagawa, Japan

[21] Appl. No.: 801,913

[22] Filed: Dec. 3, 1991

[30] Foreign Application Priority Data

Dec. 4, 1990 [JP] Japan ..... 2-403994
Jul. 15, 1991 [JP] Japan ..... 3-198310

[51] Int. Cl.[5] ..... G03D 3/08

[52] U.S. Cl. ..... 354/320; 134/64 P

[58] Field of Search ..... 354/297, 303, 305, 312, 354/319, 320-324; 134/64 P, 64 R, 122 P, 122 R

[56] References Cited

U.S. PATENT DOCUMENTS 3,682,082 8/1972 Stievenart ..... 354/318
5,109,246 4/1992 Yamamoto .

FOREIGN PATENT DOCUMENTS 62-240967 10/1987 Japan .
62-240969 10/1987 Japan .
62-240970 10/1987 Japan .
63-216050 9/1988 Japan .

*Primary Examiner*—Michael L. Gellner
*Assistant Examiner*—D. Rutledge
*Attorney, Agent, or Firm*—Sughrue Mion Zinn Macpeak & Seas

[57] ABSTRACT

High-quality and very rapid processing of light-sensitive materials are accomplished by a wet method with a compact apparatus. A process roller is at least partially submerged in a processing solution in a processing tank. Light-sensitive material is transported as it engages the periperal surface of that part of the process roller which is submerged in the processing solution. The absolute value of the peripheral speed of process roller is greater than the absolute value of the transport speed of the light-sensitive material. The roller is rotated at a speed of at least 75 rpm. With the invention, the light-sensitive material can be processed in a very rapid and yet satisfactory manner since the processing solution is rapidly replaced by fresh solution at the surface of the light-sensitive material. In addition, only a small amount of the processing solution need be used, which contributes to a reduction in the size of the processing apparatus.

44 Claims, 6 Drawing Sheets

APPARATUS FOR PROCESSING LIGHT-SENSITIVE MATERIALS

BACKGROUND OF THE INVENTION

The present invention relates to an apparatus for processing light-sensitive materials by a wet method. More particularly, the present invention relates to an apparatus that is capable of rapid and high-quality processing of light-sensitive materials in a consistent manner.

Apparatus are available in which exposed light-sensitive materials are subjected to various treatments including development, bleaching, fixing, bleach-fixing, washing with water, stabilization and drying, whereby an image is formed on the processed light-sensitive materials. Among the post-exposure steps mentioned above, the steps of washing with water and stabilization are sometimes collectively referred to as "cleaning steps." The post-exposure treatments are usually performed by a process in which the exposed light-sensitive material being transported is successively immersed in the associated processing solutions.

One of the objectives of recent research and development efforts in the photographic industry is to process all types of light-sensitive materials in a simpler and more rapid way. However, if the conventional apparatus which allow exposed light-sensitive materials to be immersed in processing solutions plified and made compact, the proportion of the overall processing time occupied by the immersion times is decreased, to thereby reduce the effective processing period.

With a view to overcoming this disadvantage, various non-immersion systems have been proposed for use in the cleaning apparatus (or the apparatus for washing with water). JP-A Sho. 62-240967 and JP-A Sho. 62-240969 ("JP-A" designating an Unexamined Japanese Patent Publication) describe apparatus for cleaning the surface of light-sensitive materials under running water, and JU-A Sho. 50-947 and JU-A Sho. 51-147442 ("JU-A" designating an Unexamined Japanese Utility Model Publication) describe apparatus for washing with cleaning water that is sprayed over light-sensitive materials.

However, those treatments are not perfectly adapted for rapid processing. One probable reason is that the processing solution present near the surface of a light-sensitive material cannot be smoothly replaced by a fresh supply of the same processing solution.

Consider, for example, the step of washing with water. If a light-sensitive material having a bleach-fixing solution deposited thereon is immediately dried, the components in the bleach-fixing solution such as thiosulfates and silver complex salts of thiosulfates will crystallize on the surface of the dried light-sensitive material or react with image silver during storage to cause a color change or fading in the image. Further, the silver complex salt dissolved in the blix solution will convert to contaminant silver sulfide. Hence, the light-sensitive material must be washed with water and stabilized in order to remove those unwanted components from the surface of the light-sensitive material or from within the emulsion film.

If washing is to be done by immersing the light-sensitive material in washing water, a transport system is necessary for transporting the light-sensitive material through a washing tank accommodating a large volume of washing water into which the material can be immersed. This increases not only the complexity of the transport mechanism, but also the size of the overall system. Further, the need to immerse the light-sensitive material in washing water for a predetermined time results in prolonged washing.

JP-A Sho. 63-216050 describes an apparatus in which a light-sensitive material is immersed in washing water in a washing tank in slit form. This apparatus is capable of efficient washing with a small volume of water but, on the other hand, the system is complex and involves difficult maintenance.

The apparatus described in JP-A Sho. 62-240967 and JP-A Sho. 62-240969 in which the surface of a light-sensitive material is washed under running water have the disadvantage that the use of running water alone is insufficient to achieve satisfactory washing.

JP-A Sho. 62-240970 describes an apparatus that permits running water to be supplied in a plurality of stages, but this system is bulky and complex and involves difficult maintenance.

The apparatus described in JU-A Sho. 50-947 and JU-A Sho. 51-147442 in which a light-sensitive material is wahsed with a water jet also have the disadvantage that the use of a water jet alone is insufficient to achieve satisfactory washing.

SUMMARY OF THE INVENTION

As will be apparent from the foregoing description, the principal object of the present invention is to provide an apparatus with which light-sensitive materials can be processed very rapidly in a manner that is simple and that will not cause deterioration in the quality of processed light-sensitive materials.

The above-stated and other objects of the present invention can be accomplished by the processing an apparatus for processing a light-sensitive material that comprises a process roller rotatable with at least part of the roller being submerged in a processing solution and means for transporting the light-sensitive material with its emulsion-coated surface being in engagement with the peripheral surface of that part of the process roller which is within the processing solution, the light-sensitive material being processed as it remains in engagement with the process roller, which is rotated at a speed of at least 75 rpm, with the absolute value of its peripheral speed being greater than that of the transport speed of the light-sensitive material.

The above and other objects of the invention can also be attained by the provision of an apparatus for processing a light-sensitive material that comprises a process roller rotatable with at least part of the roller being submerged in a cleaning solution and means for transporting the light-sensitive material with its emulsion-coated surface being in engagement with the peripheral surface of that part of the process roller which is within the cleaning solution, the light-sensitive material being cleaned as it remains in engagement with the process roller, which is rotated at a speed of at least 75 rpm.

DESCRIPTION OF THE PREFERRED EMBODIMENTS

Figure 1:
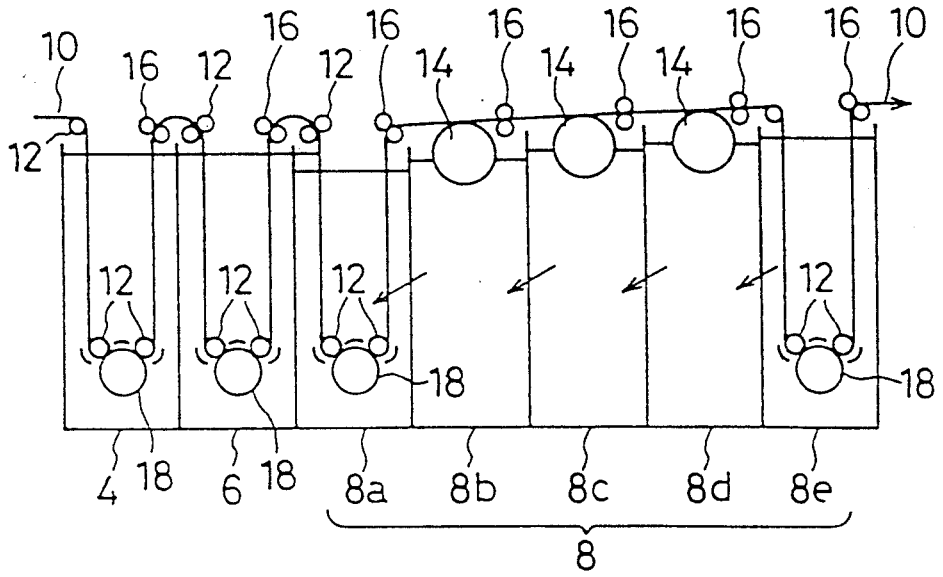
FIG. 1 is a schematic diagram showing the construction of an apparatus for processing light-sensitive materials according to a preferred embodiment of the present invention.

When a light-sensitive material is transported in the same direction as that of the rotation of the process roller, and if the transport speed is the same as the peripheral speed of the process roller, the light-sensitive material and the process roller will not slide against each other in the transport direction of the light-sensitive material and, therefore, even if the light-sensitive material is in contact with the process roller, there will be no linear abrasion marks that develop on the surface of the light-sensitive material in the direction of its transport. Under such speed conditions, the process roller is capable of not only processing the light-sensitive material but also transporting it. However, if more positive transport of the light-sensitive material is required, it is urged against the process roller so as to exert pressure in the area of contact. Then, the light-sensitive material will not slide against the process roller in the direction of its transport; however, because of movements in a serpentine path or other phenomena, the light-sensitive material will slide against the process roller in its axial direction and abrasion marks can sometimes develop in an indefinite direction.

Surface flaws such as abrasion marks will develop in the light-sensitive material when it is being processed in contact with the process roller and the reason for their occurrence is that the tiny projections due to the surface roughness of the process roller are brought into an urging or sliding engagement with the light-sensitive material. The occurrence of such flaws can be prevented by providing a specular finish on the surface of the process roller but, in practice, it is difficult for economic and other reasons to achieve a specular surface on the roller to such an extent that no surface flaws will occur.

Thus, no surface flaws will develop in the light-sensitive material if it is processed in such a way that the process roller will not contact it. Stated more specifically, the light-sensitive material can be processed without contact with the process roller if it is insured that the processing solution with which the light-sensitive material is to be processed will always form a liquid film between the lightsensitive material and the process roller. In order to insure that a film of the processing solution will always form between the light-sensitive material and the process roller, the process roller can be rotated in such a way that the processing solution is constantly supplied into the space between the light-sensitive material and the process roller, whereby a predetermined amount of the processing solution is always retained in that space. As the process roller rotates, the processing solution is constantly supplied into the space between the light-sensitive material and the process roller and the thus-supplied processing solution will continuously leave the surface of the light-sensitive material while maintaining a sufficient amount to provide a substantially constant thickness of liquid film, whereby the processing solution is rapidly replaced by a fresh solution to achieve satisfactory processing. The film of processing solution formed between the process roller and the light-sensitive material is set in such a thickness that it will not break even if the light-sensitive material is urged against the process roller. If the process roller is rotated at a very low speed, only a small amount of the processing solution is supplied into the space between the process roller and the light-sensitive material, and thus the resulting liquid film is thin enough to break easily, causing the light-sensitive material to contact the process roller so that surface flaws will develop in that material.

The amount of the processing solution that can be held between the process roller and the light-sensitive material depends primarily upon the rotational speed of the process roller. If the rotational speed of the process roller is increased, one may expect that the severity of surface flaws in the light-sensitive material would increase. In fact, however, as the process roller rotates, the processing solution around the roller will move in the same direction as the direction of its rotation under the action of viscosity, whereupon more of the processing solution will be supplied into the space between the process roller and the light-sensitive material to eliminate the chance of occurrence of surface flaws in the light-sensitive material. The thickness of the film of the processing solution can theoretically be adjusted by various factors including the rotational speed of the process roller, its peripheral speed, its diameter and the transport speed of the light-sensitive material but, in practice, the thickness of liquid films is dependent so predominantly upon the rotational speed of the process roller that the film thickness will vary by adjustment of the rotational speed but not vary greatly with other factors.

Thus, in accordance with the present invention, the light-sensitive material is transported with its emulsion-coated surface being placed in engagement with the peripheral surface of that part of a process roller which is submerged in the processing solution while the process roller is rotated at a speed of at least 75 rpm. By so doing, the light-sensitive material can be processed with a smaller amount of processing solution in an efficient and very rapid way and, therefore, the processing apparatus can be made compact. If the process roller is rotated at a speed of at least 75 rpm, a predetermined amount of the processing solution is held between the process roller and the light-sensitive material to form a liquid film that permits the light-sensitive material to be efficiently processed without making contact with the process roller.

The process roller should be rotated at a speed of at least 75 rpm, preferably at least 300 rpm. The rotational speed of the process roller can be increased up to the extent that will not cause the processing solution to be atomized and splash over the light-sensitive material. However, if the rotational speed of the process roller is too fast, problems will occur in association with the design of machines, so the range of 300–1500 rpm is preferred in practical applications. The peripheral speed of the process roller which is rotated at 75 rpm and faster is determined by its radius but considering the actual setting of the transport speed of the light-sensitive material, the absolute value of the peripheral speed of the roller will in no case become smaller than the absolute value of the transport speed of the light-sensitive material and the form is preferably at least 1.5 times as much as the latter.

The process roller to be used in the actual apparatus has a diameter of 0.5–20 cm, preferably 1.0–10 cm, more preferably 1.0–7.0 cm. If a process roller of this size is used, the transport speed of the light-sensitive material is preferably in the range of 0.2–20 cm/sec, more preferably 0.5–10 cm/sec, with the range of 0.5–4 cm/sec being particularly preferred. The slower the transport speed, the better since the overall size of the apparatus can be reduced.

The peripheral speed of the process roller is at least 5 m/min, preferably at least 20 m/min, more preferably at least 60 m/min. The faster the peripheral speed, the greater the effect of processing such as cleaning but, on the other hand, problems will arise as exemplified by the need of using a large drive motor. Thus, the range of peripheral speeds that is preferred for practical purposes is 20–200 m/min. In practice, it was verified that the present invention could achieve the intended result with the process roller rotating at peripheral speeds of up to 150 km/hr.

In accordance with the present invention, the absolute value of the peripheral speed of the process roller is preferably at least 1.5 times the absolute value of the transport speed of the light-sensitive material. The present inventors have confirmed that the advantages of the present invention can be attained up to 1500 times as fast as the transport speed of the light-sensitive material. The speed ratio is preferably 20–1000 more preferably 30–500, and most preferably 60–300. The higher this speed ratio, the greater the amount of the processing solution that is supplied to be held between the process roller and the light-sensitive material and, hence, the greater the processing effect, in particular the cleaning effect, that can be attained.

In a step of processing accordance with the present invention, such as in the cleaning step, the components of processing solutions that have been deposited on the light-sensitive material are removed by a rapidly replaced cleaning solution to achieve an efficient cleaning operation.

In the development step, the developing solution in contact with the emulsion-coated surface of the light-sensitive material is rapidly replaced by a fresh developing solution to enable rapid development of the light-sensitive material.

Thus, the present invention permits cleaning, development and other steps of processing to be performed in a rapid way. In addition, efficient processing can be accomplished with small amounts of processing solutions and yet a smaller number of machine components need be used, so that it is possible to construct an apparatus that is simple, compact and easy to service.

The processing solution that can be used in the present invention is not limited to any particular type as long as the light-sensitive material is to be processed in contact with the processing solution. The present invention finds particular advantage in the case where the light-sensitive material already wet with a certain processing solution is supplied with another processing solution. The term "the light-sensitive material already wet" with a certain processing solution means the light-sensitive material as it is just recovered from a developing solution, a bleach-fix solution, a bleaching solution, a fixing solution or the like.

In coating emulsions and other fluids onto light-sensitive materials, it is known that coating rollers are rotated in contact with both the fluid and light-sensitive material. Such coating rollers are mostly driven to rotate at a peripheral speed that is substantially the same as the transport speed of the light-sensitive material. If the coating rollers are rotated at peripheral speeds faster than the transport speed of the light-sensitive material, the surface of the light-sensitive material may be damaged or other problems can occur, such as the failure to maintain high precision of coating. Hence, no one has yet succeeded in operating coating systems with rollers being rotated at a faster peripheral speed than the transport of light-sensitive materials.

In fact, however, the practice of the present invention revealed that the surface of light-sensitive materials was not damaged at all even when the materials were processed with the process roller being rotated at 75 rpm and higher speeds that were faster than the transport of the light-sensitive materials. This is probably because a film of processing solution is formed between the process roller and the light-sensitive material, and further because the processing solution is subjected to continuous and fast replacement (liquid flow).

Therefore, rotating the process roller at high peripheral speed is also important from the viewpoint of liquid replacement, and it is an entirely new approach that cannot be conceived by merely extending the concept of the conventional coating methods.

The direction in which the process roller is rotated is not limited in any way but it is preferably rotated in a direction opposite to the transport of the light-sensitive material.

The shape of the surface of the roller than can be used in the present invention and its material are not limited in any particular way.

Examples of the roller include a roller that has grooves and ridges on the peripheral surface in order to make it possible for the roller to carry processing solutions, and a water-absorbing roller. From a practical viewpoint, the depth of grooves and the height of ridges on the peripheral surface of the roller are preferably in the range of 0.1–5 mm. A so called "wire rod" having a wire wound in a spiral form may be used as the roller, and the wire used in this case preferably has a diameter of 1–5 mm. Other rollers that can be used include a roller for gravure printing, a flat-faced roller and a sponge roller.

The present invention offers the advantage of achieving satisfactory processing even with a small amount of processing solution. Hence, even processing tanks with a capacity of 450 ml and below can achieve satisfactory processing. Further, with processing tanks having a capacity of 45 ml and below, satisfactory processing can be achieved using process rollers in accordance with the present invention. The lower limit of the capacity of each processing tank is not set at any particular value as long as it is capable of accommodating the necessary component in a sufficient amount to achieve the intended processing.

In contrast, if one attempts to reduce the size of processing tanks in a system that processes the light-sensitive material as it is submerged in processing solutions, it is necessary to attain a predetermined time of contact with fluids by slowing down the transport speed of the light-sensitive material but this makes it impossible to accomplish rapid processing. In addition, slower transport speeds prevent smooth replacement of fluids near the surface of the light-sensitive material. If the processing solutions are agitated with a view to insuring their smooth replacement, the liquid level will not be stabilized and the time for which the light-sensitive material is submerged in those solutions will vary to cause unevenness in the result of processing. Further, prior art systems in which the light-sensitive material is transported in one direction or reversed to travel in the other direction within processing solutions suffer from the disadvantage that the layout of system components puts substantial limits on the efforts to reduce the overall size of the apparatus.

In particular, in the situation of low-replenishment, low-frequency processing, it takes a long time for the concentration of processing solutions to reach equilibrium, and this can potentially destabilize the processing operations. To deal with this problem, it is effective to reduce the size of individual processing tanks and the amount of processing solutions to be used.

In accordance with the present invention, the light-sensitive material is processed as it remains in engagement with the peripheral surface of that part of a process roller which is submerged in a processing solution, which insures satisfactory processing of the light-sensitive material with processing tanks of a lower capacity and, hence, of a smaller size.

In the practice of the present invention, the spaces above the processing solutions are preferably made airtight in order to prevent their evaporation and oxidation. When the process roller that is at least partly submerged in processing solutions is rotated, the processing solutions have many chances to contact the air, whereupon evaporation or oxidation will proceed rapidly to reduce the processing capabilities of those solutions. Particularly in the step of washing with water in a system of rapid processing, the cleaning solution is in most cases held at high temperatures to insure rapid processing, which causes evaporation or oxidation to accelerate.

When cleaning is to be done by means of the process roller, the liquid level of the cleaning solution will drop rapidly if the liquid evaporates excessively, and the resulting failure to pick up the cleaning solution in an adequate amount causes not only insufficient cleaning but also damage to the surface of the light-sensitive material.

In order to avoid these problems, the space above the processing solutions is preferably made substantially airtight. For the purpose of preventing evaporation and oxidation of processing solutions, complete isolation of the processing solutions from air is preferred, but the space above these solutions need not be made completely airtight and making it substantially airtight will suffice.

One approach for making the space above processing solutions airtight is to provide a shield such as an airtight lid above the liquid surface of those processing solutions. Another approach is providing a floating lid that prevents contact between the liquid surface and ambient air.

In making the space above processing solutions airtight, it is important to make the inlets and outlets for the light-sensitive material airtight while reducing the degree of opening above the liquid surface. The term "substantially airtight" may be understood with reference to the disclosure in JP-A Hei. 2-84642, and it means, when expressed by a maximum slit width, a value of 1.5 mm for color developing, bleach fixing, bleaching and stabilizing solutions, and 2.5 mm for a cleaning solution. The airtight apparatus may be filled with an inert gas such as nitrogen or argon gas.

The processing solutions that can be used in the present invention include developing, fixing, bleach-fixing, water washing, stabilizing solutions, etc for processing light-sensitive materials. Such usable processing solutions have pH values of 3–13, viscosities of no more than 500 cPs, surface tensions of 15–75 dynes/cm, and specific gravities of 0.75–1.30, and suitable types can be selected from the group of such processing solutions.

When the present invention is to be applied to cleaning treatments, cleaning solutions that can be used include ion-exchanged water and tap water. These cleaning solutions may contain antiseptics, chelating agents, surfactants, pH buffering agents, optical brightening agents, mold inhibitors, hardenrs, etc.

When multi-stage cleaning is to be performed in the cleaning step with a plurality of cleaning tanks being provided, satisfactory results can be accomplished by applying the concept of the present invention to at least one of the tanks. Further, it is preferred to adopt a "countercurrent system" in multi-stage cleaning, in which the tank in the last stage is replenished with a cleaning solution which is successively transferred backward to preceding tanks. The tank in the last stage is preferably replenished with the cleaning solution in an amount which is 0.5–3 times the volume of the cleaning solution carried in by the light-sensitive material from the preceding tank. Further, the cleaning step is preferably completed within 30 seconds.

The apparatus of the present invention can be used to process any kind of light-sensitive material that is to be processed with processing solutions, including, for example, black-and-white photographic materials for printing, medical and general purposes, as well as color photographic materials such as color negative films, color reversal films and color papers. The apparatus of the present invention is suitable for processing color prints by taking advantage of its capability for rapid processing, and it may be applied to the processing of intelligent color hard copies which particularly need to be processed rapidly.

When the present invention is applied to the processing of intelligent color hard copies, exposure is preferably performed by scanning with high-density light such as light from a laser (e.g., semiconductor laser) or a light-emitting diode.

The apparatus of the present invention exhibits a particularly effective cleaning action when it is used for very rapid cleaning of color photographic materials of the type described in the discussion of the preferred embodiments of the invention later in this specification and in the specification of Japanese Patent Application No. Hei. 1-232590.

Halides that can be used in the light-sensitive materials to be processed by the present invention include, for example, silver chloride, silver bromide, silver (iodo)-chlorobromide and silver iodobromide. For the purpose of rapid processing, silver chlorobromide emulsions that are substantially free of silver iodide and which have silver chloride contents of at least 90 mol %, preferably at least 95 mol %, more preferably at least 98 mol %, or silver chloride emulsions are preferably used.

For such purposes as improving the sharpness of the image, the light-sensitive material to be processed by the present invention preferably contains in hydrophilic colloidal layers those dyes (particularly oxonole dyes) which can be decolored by processing and which are described on pages 27–76 of the specification of European Patent EP 0,337,490 A2, with those dyes being added in such amounts that the light-sensitive material will have an optical reflection density of at least 0.70 at 680 nm. The light-sensitive material may also contain in the water-resistant resin layer on the support at least 12 wt % (more preferably at least 14 wt %) of titanium oxide that is surface treated with dihydric to tetrahydric alcohols (e.g., trimethylolethane).

It is also preferred that compounds for improving the keeping quality of the color image as described in the specification of European Patent EP 0,277,589 A2 are used with couplers in the light-sensitive material to be processed by the present invention. It is particularly preferred to use such compounds in combination with pyrazoloazole couplers.

Compounds that bind chemically with aromatic amino color developing agents remaining after color development to produce chemically inert and substantially colorless compounds and/or compounds that bind chemically with the oxidation product of aromatic amino color developing agents remaining after color development to produce chemically inert and substantially colorless compounds are preferably used either independently or in combination for the purpose of preventing staining and other side effects caused by the formation of color dyes upon reaction between couplers and the residual color developing agents or oxidation product thereof during storage after processing.

It is also preferred that the light-sensitive material to be processed by the present invention have incorporated therein mold inhibitors of the type described in Unexamined Published JP-A Sho. 63-271247 for the purpose of preventing various fungi and bacteria from growing in hydrophilic colloidal layers to cause image deterioration.

For display purposes, white polyester-based supports or supports having a layer containing a white pigment on the side where a silver halide emulsion layer is formed may be used with the light-sensitive material that is to be processed by the present invention. For providing improved sharpness, an antihalo layer is preferably coated on the side of the support where a silver halide emulsion layer is coated, or on the opposite side. For permitting the display to be viewed under reflected or transmitted light, it is particularly preferred to set the transmission density of the support within the range of 0.35–0.8.

The light-sensitive material to be processed by the present invention may be exposed under visible or infrared light. Exposure may be continued for a long period at low intensity or for a short period at high intensity. In the latter case, exposure by scanning under laser light, with the exposure time being shorter than $10^{-4}$ seconds per pixel, is particularly preferred.

In exposure, a band-stop filter of the type described in U.S. Pat. No. 4,880,726 is preferably used. This eliminates the mixing of light colors, thereby achieving marked improvement in color reproduction.

Exposed light-sensitive materials may be subjected to color development but, for the purpose of rapid processing, a bleach-fixing treatment is preferably performed after color development. Particularly in the case of using the aforementioned emulsions Of high silver chloride content, the pH of the bleach-fixing solution is preferably adjusted to about 6.5 or below, more preferably about 6 or below, for such purposes as accelerating the desilvering process.

For information on the silver halide emulsions and other components (e.g., additives) and the photographic constituent layers (including their arrangement) that are preferably used in the light-sensitive materials to be processed by the present invention, as well as the methods and additives that maybe employed to process those light-sensitive materials, reference may be had to the following patent literature, especially the specification of European Patent EP 0,355,660 A2 (corresponding to JP-A Hei. 2-139544).

| Photographic constituent elements, etc. | JP-A Sho.62-215272 | JP-A Hei. 2-33144 | EP 0,355,660 A2 |
|---|---|---|---|
| Silver halide emulsion | p. 10, upper right col., 1. 6 to p. 12, lower left col., 1. 5 and p. 12, lower right col., 1. 4 from the bottom to p. 13, upper left col., 1. 17 | p. 28, upper right col., 1. 16. to p. 29, lower right col., 1. 11, and p. 30, 11. 2–5 | p. 45, 1. 53 - p, 47, 1. 3, and p. 47, 11. 20–22 |
| Silver halide solvent | p. 12, lower left col., 1. 6–14 and p. 13, upper left col., 1. 3 from the bottom to p. 18, lower left col., last line | | |
| Chemical sensitizer | p. 12, lower left col., 1. 3 from the bottom to lower right col., 1. 5 from the bottom and p. 18, lower right col., 1. 1 to p. 22, upper right col., 1. 9 from the bottom | p. 29, lower right col., 1. 12 to the last line | p. 47, 11. 4–9 |
| Spectral sensitizer (spectral sensitization) | p. 22, upper right col., 1. 8 from the bottom to p. 38, last line | p. 30, upper left col., 11. 1–13 | p. 47, 11. 10–15 |
| Emulsion stabilizer | p. 39, upper left col., 1. 1 to p. 72, upper right col., last line | p. 30, upper left col., 1. 14 to upper right col., 1. 1 | p. 47, 11. 16–19 |
| Development accelerator | p. 72, lower left col., 1. 1 to p. 91, upper right col., 1.3 | | |
| Color couplers | p. 91, upper | p. 3, upper | p. 4, 11. 15– |

-continued

| Photographic constituent elements, etc. | JP-A Sho.62-215272 | JP-A Hei. 2-33144 | EP 0.355.660 A2 |
|---|---|---|---|
| (cyan, magenta and yellow couplers) | right col., l. 4 to p. 121, upper left col., l. 6 | right col., l. 14 to p. 18, upper left col., last line and p. 30, upper right col., l. 6 to p. 35, lower right col., l. 11 | 27, p. 5, l. 40 to p. 28, last line, p. 45, ll. 29-31, p. 47, l. 23 to p. 63, l. 50 |
| Color intensifier | p. 121, upper left col., l. 7 to p. 125, upper right col., l. 1 | | |
| UV absorber | p. 125, upper right col., l. 2 to p. 127, lower left col., last line | p. 37, lower right col., l. 14 to p. 38, upper left col., l. 11 | p. 65, ll. 22-31 |
| Antifading agent (image stabilizer) | p. 127, lower right col., l. 1 to p. 137, lower left col., l. 8 | p. 36, upper right col., l. 12 to p. 37, upper left col., l. 19 | p. 4, l. 30 to p. 5, l. 23, p. 29, l. 1 to p. 45, l. 25, p. 45, ll. 33-40, p. 65, ll. 2-21 |
| High-boiling and/or low-boiling point organic solvent | p. 137, lower left col., l. 9 to p. 144, upper right col., last line | p. 35, lower right col., l. 14 to p. 36, upper left col., l. 4 from the bottom | p. 64, ll. 1-51 |
| Method of dispersing photographic additives | p. 144, lower left col., l. 1 to p. 146, upper right col., l. 7 | p. 27, lower right col., l. 10 to p. 28, upper left col., last line and p. 35, lower right col., l. 12 to page 36, upper right col. l. 7 | p. 63, l. 51 to p. 64, l. 56 |
| Hardener | p. 146, upper right col., l. 8 to p. 155, lower left col. l. 4 | | |
| Precursor of developing agent | p. 155, lower left col., l. 5 to p. 155, lower right col., l. 2 | | |
| Development restrainer releasing compound | p. 155, lower right col., ll. 3-9 | | |
| Support | p. 155, lower right col., l. 19 to p. 156, upper left col., l. 14 | p. 38, upper right col. l. 18 to p. 39, upper left col., l. 3 | p. 66, l. 29 to p. 67, l. 13 |
| Constitution of light-sensitive layers | p. 156, upper left col., l. 15 to p. 156, lower right col., l. 14 | p. 28, upper right col., ll. 1-15 | p. 45, ll. 41-52 |
| Dyes | p. 156, lower right col., l. 15 to p. 184, lower right col., last line | p. 38, upper left col., l. 12 to upper right col., l. 7 | p. 66, ll. 18-22 |
| Anti-color mixing agent | p. 185, upper left col., l. 1 to p. 188, lower right col., l. 3 | p. 36, upper right col., ll. 8-11 | p. 64, l. 57 to p. 65, l. 1 |
| Contrast modifying agent | p. 188, lower right col., ll. 4-8 | | |
| Anti-stain agent | p. 188, lower right col., l. 9 to p. 193, lower right col., l. 10 | p. 37, upper left col., last line to lower right col., l. 13 | p. 65, l. 32 to p. 66, l. 17 |
| Surfactant | p. 201, lower left col., l. 1 to p. 210, upper right col., last line | p. 18, upper right col., l. 1 to p. 24, lower right col., last line and p. 27, lower left col., l. 10 from the bottom to lower right col., l. 9 | |
| Fluorine-containing compounds (as antistatic coating aid, lubricant, anti-blocking agent, etc.) | p. 210, lower left col., l. 1 to p. 222, lower left col., l. 5 | p. 25, upper left col., l. 1 to p. 27, lower right col., l. 9 | |
| Binder (hydrophilic binder) | p. 222, lower left col., l. 6 to p. 225, upper left col., last line | p. 38, upper right col. ll. 8-18 | p. 66, ll. 23-28 |
| Thickener | p. 225, upper right col., l. 1 to p. 227, upper right col., l. 2 | | |
| Antistat | p. 227, upper right col., l. 3 to p. 230, upper left col., l. 1 | | |
| Polymer latex | p. 230, upper left col., l. 2 to p. 239, last line | | |
| Matting agent | p. 240, upper left col., l. 1 to p. 240, upper right col., last line | | |
| Method of photographic processing (e.g., processing steps and additives) | p. 3, upper right col., l. 7 to p. 10, upper right col., l. 5 | p. 39, upper left col., l. 4 to p. 42, upper left col., last line | p. 67, l. 14 to p. 69, l. 28 |

Notes: The quotations from JP-A Sho. 62-215272 include the amendments effected under date of Mar. 16, 1987, and which are annexed at the end of the publication. Among the color couplers mentioned above, the yellow couplers may preferably be those "shifted to shorter wavelength in spectral absorption" as described in JP-A Sho. 63-231451, JP-A Sho. 63-123047, JP-A Sho. 63-241547, JP-A Hei. 1-173499, JP-A Hei. 1-213648 and JP-A Hei 1-250944.

In addition to the diphenylimidazole-based cyan couplers described in JP-A Hei. 2-33144, the following couplers are preferably used as cyan couplers: the 3-hydroxypyridine based cyan couplers described in the specification of European Patent EP 0,333,185 A2 (among those, specifically mentioned coupler (42) which is converted from 4-equivalent to 2-equivalent type by incorporating a leaving Cl group, as well as couplers (6) and (9) are particularly preferred), and the cyclic active methylenic cyan couplers described in JP-A Sho. 64-32260 (among those, specifically mentioned couplers 3, 8 and 34 are particularly preferred).

The color photographic materials to be used in the present invention are preferably subject to color development, bleach-fixing and washing with water (or stabilization). Bleaching and fixing may be performed either in a single bath or in separate baths.

The color developing solution to be used in the present invention contains known aromatic primary amino color developing agnets. Preferred examples are p-phenylenediamine derivatives, and typical, but by no means limiting, examples of such derivatives are listed below:

| | |
|---|---|
| D-1 | N,N-Diethyl-p-phenylenediamine |
| D-2 | 4-Amino-N,N-diethyl-3-methylaniline |
| D-3 | 4-Amino-N-(β-hydroxyethyl)-N-methylaniline |
| D-4 | 4-Amino-N-ethyl-N-(β-hydroxyethyl)aniline |
| D-5 | 4-Amino-N-ethyl-N-(β-hydroxyethyl)-3-methylaniline |
| D-6 | 4-Amino-N-ethyl-N-(3-hydroxypropyl)-3-methylaniline |
| D-7 | 4-Amino-N-ethyl-N-(4-hydroxybutyl)-3-methylaniline |
| D-8 | 4-Amino-N-ethyl-N-(β-methanesulfonamidoethyl)-3-methylaniline |
| D-9 | 4-Amino-N,N-diethyl-3-(β-hydroxyethyl)aniline |
| D-10 | 4-Amino-N-ethyl-N-(β-methoxyethyl)-3-methylaniline |
| D-11 | 4-Amino-N-(β-ethoxyethyl)-N-ethyl-3-methylaniline |
| D-12 | 4-Amino-N-(3-carbamoylpropyl)-N-n-propyl-3-methylaniline |
| D-13 | 4-Amino-N-(4-carbamoylbutyl)-N-n-propyl-3-methylaniline |
| D-14 | N-(4-Amino-3-methylphenyl)-3-hydroxypyrrolidine |
| D-15 | N-(4-Amino-3-methylphenyl)-3-(hydroxymethyl)pyrrolidine |
| D-16 | N-(4-Amino-3-methylphenyl)-3-pyrrolidinecarboxamide. |

Among the p-phenylenediamine derivates listed above, illustrative compounds D-5, D-6, D-7, D-8 and D-12 are particularly preferred. These p-phenylenediamine derivates may be in the form of such salts as sulfates, hydrochlorides, sulfites, naphthalene-disulfonates and p-toluenesulfonates. The aromatic primary amino developing agents are used in amounts that preferably range from 0.002 moles to 0.2 moles, more preferably from 0.005 moles to 0.1 mole, per liter of the developing solution.

In the practice of the present invention, developing solutions that are substantially free from benzyl alcohol are preferably used. The term "substantially free from benzyl alcohol" means that the developing solutions preferably have a benzyl alcohol concentration of 2 ml/l or less, more preferably 0.5 ml/l or less. Most preferably, the developing solutions contain no benzyl alcohol at all.

More preferably, the developing solution to be used in the present invention is substantially free of sulfite ions. Sulfite ions serve as a preservative for the developing agent but, at the same time, they dissolve silver halides and react with the oxidation product of the developing agent to reduce the efficiency of dye formation. These actions of sulfite ions are believed to be one of the causes of increasing the variations in photographic characteristics that accompany continuous processing. The term "substantially free of sulfite ions" as used herein means that the developing solution preferably contains sulfite ions at concentrations of no more than $3.0\times10^{-3}$ moles/l, and that most preferably it does not contain sulfite ions at all. It should, however, be noted that a very small amount of sulfite ions are used to prevent the oxidation of photochemical kits containing developing agents in a concentrated form before they are conditioned to tank solutions for use, and the aforementioned statement they the "developing solutions are preferably substantially free of sulfite ions" does not apply to such sulfite ions.

As already mentioned, the developing solutions for use in the present invention are preferably substantially free of sulfite ions. Further, it is preferred that such developing solutions also be substantially free of hydroxylamine. This is because hydroxylamines, which serve as a preservative for developing solutions, also have a silver developing activity by themselves and because variations in the concentration of hydroxylamines are considered to have substantial effects on photographic characteristics. The term "substantially free of hydroxylamine" as used herein means that the developing solution preferably contains hydroxylamine at concentrations of no more than $5.0\times10^{-3}$ moles/l, and that most preferably it does not contain hydroxylamine at all.

In a more preferred case, the developing solution for use in the present invention contains organic preservatives in place of hydroxylamine and sulfite ions.

The term "organic preservatives" as used herein pertains to a class of organic compounds which, when added to processing solutions for color photographic materials, will reduce the rate of deterioration of aromatic primary amino color developing agents. In other words, organic preservatives are organic compounds that have the capability for preventing aerial and otherwise oxidation of color developing agents. Particularly, effective organic preservative include hydroxylamine derivates (excepting hydroxylamine, and this is also true in the following description), hydroxamic acids, hydrazines, hydrazides, phenols, α-hydroxyketones, αaminoketones, saccharides, monoamines, diamines, polyamines, quaternary ammonium salts, nitroxyl radicals, alcohols, oximes, diamide compounds, condensed cyclic amines, etc. These compounds are disclosed in various publications and specifications such as JP-A Sho. 63-4235, JP-A Sho. 63-30845, JP-A Sho. 63-21647, JP-A Sho. 63-44655, JP-A Sho. 63-53551, JP-A Sho. 63-43140, JP-A SHO 63-56654, JP-A Sho. 63-58346, JP-A Sho. 63-43138, JP-A Sho. 63-146041, JP-A Sho. 63-44657, JP-A Sho. 63-44656, U.S. Pat. Nos. 3,615,503, 2,494,903, JP-A Sho. 52-143020, and JP-B Sho. 48-30496 (the term "JP-B designates an Examined Japanese Patent Publication).

Other preservatives may be incorporated as required, including the various metals described in JP-A Sho. 57-44148 and JP-A Sho. 57-53749, the salicylic acids described in JP-A Sho. 59-180588, the alkanolamines described in JP-A Sho. 54-3532, the polyethyleneimines described in JP-A Sho. 56-94349, and aromatic polyhydroxy compounds as described in U.S. Pat. No. 3,746,544. It is particularly preferred to add alkanolamines such as triethanolamine, dialkylhydroxylamines such as diethylhydroxylamine, as well as hydrazine derivates and aromatic polyhydroxy compounds.

Among the organic preservatives described above, hydroxylamine derivatives and hydrazine derivaties (e.g., hydrazines and hydrazides) are particularly preferred. For further information, see JP-A Hei. 1-97953, JP-A Hei. 1-186939, JP-A Hei. 1-186940, JP-A Hei. 1-187557, etc.

The hydroxylamine or hydrazine derivatives described above may be used in combination with amines, and this is more preferred for the purpose of improving the stability of color developing solutions and, hence, for the purpose of improving the consistency of continuous processing.

The amines that can be used together with those hydroxylamine or hydrazine derivatives include cyclic amines of the type described in JP-A Sho. 63-239447, amines of the type described in JP-A Sho. 63-128340, and amines of the type described in JP-A Hei. 1-186939 and JP-A Hei. 1-187557.

The color developing solution for use in the present invention preferably contains chloride ions in amounts of $3.5\times10^{-2}$ to $1.5\times10^{-1}$ moles/l, more preferably $4\times10^{-2}$ to $1\times10^{-1}$ moles/l, development is retarded. This is not preferred for attaining a maximum density in a rapid way. If concentration of chloride ions is less than $3.5\times10^{-2}$ moles/l, fogging cannot be effectively prevented.

The color developing solution for use in the present invention preferably contains bromide ions in amounts of $3.0\times10^{-5}$ to $1.0\times10^{-3}$ moles/l, more preferably $5.0\times10^{-5}$ to $5\times10^{-4}$ moles/l. If the concentration of bromide ions is more than $1\times10^{-3}$ moles/l, development is retarded to reduce the maximum density and sensitivity that can be attained. If the concentration of bromide ions is less than $3.0\times10^{-5}$ moles/l, fogging cannot be effectively prevented.

Chloride and bromide ions may be directly added to the developing solution or, alternatively, they may be released from the light-sensitive material into the developing solution during development.

In the case of direct addition to the color developing solution, exemplary materials that serve as chloride ion suppliers include sodium chloride, potassium chloride, ammonium chloride, lithium chloride, nickel chloride, magnesium chloride, manganese chloride, calcium chloride and cadmium chloride, with sodium chloride and potassium chloride being preferred.

Chloride ions may be supplied from optical brightening agents incorporated in the developing solution.

Exemplary materials that serve as bromide ion suppliers include sodium bromide, potassium bromide, ammonium bromide, lithium bromide, calcium bromide, magnesium bromide, manganese bromide, nickel bromide, cadmium bromide, cerium bromide and thallium bromide, with potassium bromide and sodium bromide being preferred.

In the case of release from the light-sensitive material during development, chloride or bromide ions may both be supplied from emulsions or, alternatively, they may be supplied from other than emulsions.

The color developing solution for use in the present invention preferably has a pH of 9-12, more preferably 9-11.0. The color developing solution may also contain other compounds that are known to be used as components of developing solutions.

Various buffering agents are preferably used to maintain the pH of the color developing solution in the ranges set forth above. Useful buffering agents include carbonates, phosphates, borates, tetraborates, hydroxybenzoates, glycine salts, N,N -dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, lysine salts, etc. Among these compounds, carbonates, phosphates, tetraborates and hydroxybenzoates have high solubility, exhibit good buffering action in the high pH range (pH $\geqq$ 9.0), cause no adverse effects (e.g., fogging) on photographic performance even if they are present in the developing solution, and they are inexpensive. Because of these advantages, the four specific types of buffering agents mentioned above are used with particular preference.

Specific examples of those buffering agents include: sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). It should, however, be noted that the present invention is by no means limited to those compounds only.

The buffering agents described above are preferably added to the color developing solution in amounts of at least 0.1 mole/l, with the range of 0.1-0.4 moles/l being particularly preferred.

Various chelating agents may be used in the color developing solution either as agents to prevent precipitation of calcium and magnesium, or for the purpose of improving the stability of the color developing solution. Exemplary chelating agents include nitrilotriacetic acid, diethylenetriaminepentaacetic acid, ethylenediaminetetraacetic acid, N,N,N,-trimethylenephosphonic acid, ethylenediamine -N,N,N',N'-tetramethylenesulfonic acid, transcyclohexanediaminetetraacetic acid, 1,2-diaminopropanetetraacetic acid, glycoletherdiaminetetraacetic acid, ethylenediamineorthohydroxypenylacetic acid, 2-phosphonobutane-1,2,4-tricarboxylic acid, 1-hydroethylidene-1,1-diphosphonic acid, N,N'-bis(2-hydroxybenzyl)ethylenediamine-N,N'-diacetic acid, etc.

Depending on the need, these chelating agents may be used as admixtures. These chelating agents only need be added in amounts that are sufficient to sequester metal ions in the color developing solution, and the range of about 0.1-10 g per liter may be mentioned as a guide.

If necessary, any development accelerator may be added to the color developing solution. Development accelerators that may be added as required include thioether compounds as described in JP-B Sho. 37-16086, JP-B Sho. 37-5987, JP-B Sho. 38-7826, JP-B Sho. 44-12380, JP-B Sho. 45-9019, U.S. Pat. No. 3,813,247, etc.; p-phenylenediamine compounds as described in JP-A Sho. 52-49829 and JP-A Sho. 50-15554; quaternary ammonium salts as described in JP-A Sho. 50-137726, JP-B Sho. 44-30074, JP-A Sho. 56-156826 and JP-A Sho. 52-43429; amine compounds as described in U.S. Pat. Nos. 2,494,903, 3,128,182, 4,230,796, 3,253,919, JP-B Sho. 41-11431, U.S. Pat. Nos. 2,482,546, 2,596,926 and 3,582,346; polyalkylene oxides as described in JP-B Sho. 37-16088, JP-B Sho. 42-25201, U.S. Pat. No. 3,128,183, JP-B Sho. 41-11431, JP-B Sho. 42-23883 and U.S. Pat. No. 3,532,501; as well as 1-phenyl-3-pyrazolidones and imidazoles.

An antifoggant can also be added, as required to the color developing solution for use in the present invention. Useful antifoggants include alkali metal halides (e.g., sodium chloride, potassium bromide and potassium iodide) and organic antifoggants. Typical examples of organic antifoggants are nitrogenous heterocyclic compounds including benzotriazole, 6-nitrobenzimidazole, 5-nitroisoindazole, 5-methylbenzotraizole, 5-nitrobenzotriazole, 5-chloro-benzotriazole, 2-thiazolylbenzimidazole, 2-thiazolylmethyl-benzimidazole, indazole, hydrocyazaindolidine and adenine.

The color developing solution that can be used in the present invention preferably contains optical brightening agents. Preferred optical brightening agents are 4,4'-diamino 2,2'-disulfostilbene compounds. Optical brightening agents are added in amount of 0-5 g/l, preferably 0.1-4 g/l.

Further, various surfactants such as alkylsulfonic acids, arylsulfonic acids, aliphatic carboxylic acids and aromatic carboxylic acids may be added to the color developing solution as required.

Processing with the color developing solution that can be used in the present invention is performed at temperatures of 30°-50° C., preferably 35°-50° C. The processing time ranges from 5 to 15 seconds. The amount of replenishment is preferably as small as possible. A suitable range is from 20 to 600 ml per square of the light-sensitive material, with the range of 30-100 ml being preferred.

In reducing the amount of replenishment, it is preferred to prevent the evaporation and aerial oxidation of processing solutions by reducing the area of contact with the air in processing tanks. The area of contact between the air and the processing solution in a processing tank can be expressed by the "degree of opening," which is defined as the area of contact between air and processing solution ($cm^2$) divided by the capacity of processing solution ($cm^3$). The degree of opening as defined above is preferably 0.1 or below, more preferably 0.001-0.05.

The degree of opening as defined above can be reduced by various methods. One method is to provide a shield such as a floating lid on the surface of photographic processing solutions in processing tanks. Other methods include the use of a movable lid as described in JP-A Hei. 1-82033, and processing by slit development as described in JP-A Sho. 63-216050.

Reduction in the degree of opening is preferably applied not only in a color developing or a black-and-white developing step but also in all subsequent steps such as, for example, bleaching, bleach-fixing, fixing, washing with water and stabilization.

The amount of replenishment can be reduced by adopting a means of suppressing the accumulation of bromide ions in the developing solution.

The desilvering process that can be applied in the present invention is described below. A desilvering process may generally consist of any steps that are practiced either individually or in combination, as exemplified by the combination of a bleaching step and a fixing step, the combination of a fixing step and a bleach-fixing step, the combination of a bleaching step and a bleach-fixing step, or a bleach-fixing step alone.

Next, the bleaching solution, the bleach-fixing solution and the fixing solution that can be used in the present invention will be described.

Any bleaching agent can be used in the bleaching solution or bleach-fixing solution. Particularly preferred bleaching agents include: organic complex salts of iron (III) (e.g., complex salts with aminopolycarboxylic acids such as ethylenediaminetetraacetic acid and diethylenetriaminepentaacetic acid, aminopolyphosophonic acid, phosphonocarboxylic acid and organic phosphonic acid), or organic acids such as citric acid, tartaric acid and malic acid; persulfates; hydrogen peroxide, etc.

Among the compounds listed above, organic complex salts of iron (III) are particularly preferred from the viewpoints of rapid processing and preventing environmental pollution. Examples of aminopolycarboxylic acids, aminopolyphosphonic acid, organic phosphonic acid and salts thereof that are useful in forming organic complex salts of iron (III) include ethylenediaminetetraacetic acid, diethylenetriaminepentaacetic acid, 1,3-diaminopropanetetraacetic acid, propylenediaminetetraacetic acid, nitrilotriacetic acid, cyclobexanediaminetetraacetic acid, methyliminodiacetic acid, iminodiacetic acid, glycoletherdiaminetetraacetic acid, etc. These compounds may be in the form of sodium, potassium, lithium or ammonium salts. Among the compounds listed above, iron (III) complex salts of ethylenediaminetetraacetic acid, diethylenetriaminepentaacetic acid, cyclohexanediaminetetraacetic acid, 1,3-diaminopropanetetraacetic acid and methyliminodiacetic acid are preferred on account of their high bleaching power. These complex salts of ferric ions may per se be used in the form of complex salt or, alternatively, a ferric salt such as ferric sulfate, ferric chloride, ferric nitrate, ammonium ferric sulfate or ferric phosphate may be chelated with an aminopolycarboxylic acid, aminopolyphosphonic acid, phosphonocarboxylic acid or other chelating agents to form a complex of ferric ions in solution. Chelating agents may be used in excess of the amount necessary to form complex salts of ferric ions. Among iron complexes, those with aminopolycarboxylic acids are preferred and they are added in amounts of 0.01-1.0 mol/l, preferably 0.05 to 0.50 moles/l.

The bleaching solution, the bleach-fixing solution and/or prebaths therefor may contain various compounds as bleach accelerators. Preferred examples are the compounds having a mercapto group or disulfide bond as described in U.S. Pat. No. 3,893,858, German Patent No. 1,290,812, JP-A Sho. 52-95630, and Research Disclosure No. 17129 (Jul. 1978), thiourea compounds as described in JP-B Sho. 45-8506, JP-A Sho. 52-20832, JP-A Sho. 53-32735 and U.S. Pat. No. 3,706,561, and halides containing iodide or bromide ions, and these compounds are preferred for their high bleaching power.

The bleaching solution or bleach-fixing solution that can be used in the present invention may further contain rehalogenating agents such as bromides (e.g., potassium bromide, sodium bromide and ammonium bromide), chlorides (e.g., potassium chloride, sodium chloride and ammonium chloride) and iodides (e.g., ammonium iodide). If desired, those solutions may have added thereto one or more inorganic or organic acids or alkali metal salts thereof having a pH buffering action, as exemplified by borax, sodium metaborate, acetic acid, sodium acetate, sodium carbonate, potassium carbonate, phosphorous acid, phosphoric acid, sodium phosphate, citric acid, sodium citrate and tartaric acid, or ammonium salts of those inorganic or organic acids or corrosion inhibitors such as ammonium nitrate and guanidine.

Known fixing agents can be used in the bleach-fixing solution or fixing solution, and they include thiosulfates such as sodium thiosulfate and ammonium thiosulfate, thiocyanate such as sodium thiocyanate and ammonium thiocyanate, and water soluble silver halide dissolving agents such as thioether compounds (e.g., ethylenebis-thioglycolic acid and 3,6-dithia 1,8-octanediol) and thioureas. These fixing agents may be used either independently or in combination. Also usable are special bleach-fixing solutions that contain fixing agents in combination with large amounts of halides such as potassium iodide, as described in JP-A Sho. 55-155354. The use of thiosulfates, especially ammonium thiosulfates, is preferred in the present invention. Fixing agents are preferably used in amounts of 0.2–2 moles, more preferably 0.3–1.9 moles per liter. The bleach-fixing or fixing solution has a pH that preferably ranges from 3 to 9, more preferably from 4 to 8.

The bleach-fixing solution may also contain various optical brightening agents, antifoaming agents, surfactants, or organic solvents such as polyvinyl pyrrolidone and methanol.

The bleach-fixing solution and fixing solution preferably contain sulfite-ion releasing compounds as preservatives, and they include sulfites (e.g., sodium sulfite, potassium sulfite and ammonium sulfite), bisulfites (e.g., ammonium bisulfite, sodium bisulfate and potassium bisulfate) and metabisulfites (e.g., potassium metabisulfite, sodium metabisulfite and ammonium metabisulfite). These compounds are preferably contained in amounts of about 0.02–1.0 mole/l, more preferably 0.04–0.6 moles/l, as calculated for sulfite ions.

Sulfites are generally added as preservatives, but other compounds may also be added, such as ascorbic acid, carbonyl bisulfite adducts or carbonyl compounds.

Further, buffering agents, optical brightening agents, chelating agents, antifoaming agents, antifungal agents (mold inhibitors), etc. may be added as desired.

After desilvering treatments such as fixing or bleach-fixing, the light-sensitive material is usually subjected to washing with water and/or stabilization.

The volume of water used in the washing step may be set at values variable over a wide range depending upon the characteristics (as related to couplers and other components) of the light-sensitive material and its use, the temperature of the washing water, the number of steps of washing tanks, and various other factors. Among these factors, the relationship between the number of washing tanks and the volume of water used in a multi-stage countercurrent system can be determined by the method described in Journal of the Society of Motion Picture and Television Engineers, vol. 64, pp. 248–253 (May 1955). The number of stages in a multi-stage countercurrent system is generally preferably in the range of 2–6, with the range of 2–5 being particularly preferred.

According to a multi-stage countercurrent system, the volume of washing water that need be used can be reduced markedly, for example, to 500 ml or less per square meter of the light-sensitive material, whereby the advantages of the present invention are attained in a noticeable way. However, if the volume of washing water is reduced, the water will stay within the tank for an increase period, causing such problems as bacterial growth and deposition of the resulting suspended matter on the light-sensitive material. As a solution to these problems, the method described in JP-A Sho. 62-288838, which is directed to reducing the amounts of calcium and magnesium, can be used very effectively. Also usable are the isothiazolone compounds and thiabendazole described in JP-A Sho. 57-8542, chlorine-containing bactericides such as the chlorinated sodium isocyanurate described in JP-A Sho. 61-120145, the o benzotriazole described in JP-A Sho. 61-267761, cupreous ions, and the bactericides described in "Bokin Bobai no Kagaku (Antibacterial & Antifungal Chemistry)", H. Horiguchi, Sankyo Shuppan (1986), "Biseibutsu no Genkin, Sakkin, Bobai Gijutsu (Microbial Reduction, Sterilization and Antifungal Technology)", ed. by the Committee of Hygienic Technology, Kogyo Gijutsukai (1982), and "Bokin Bobaizai Jiten (Encyclopedia of Antibacterial and Antifungal Agents)", ed. by the Society of Antibacterial and Antifungal Agents, Japan (1986).

Further, the washing water may incorporate surfactants as water drainers, or chelating agents as water softeners which may be typified by EDTA.

Treatment with a stabilizing solution may follow the washing step described above, or it may immediately follow the desilvering process (i.e., the washing step is skipped). The stabilizing solution contains compounds having a capability for image stabilization, and they include aldehyde compounds typified by formaldehyde, buffering agents for adjusting the pH of the light-sensitive material to a level suitable for dye stabilization, and ammonium compounds. Further, the various bactericides and antifungal agents described above may be used in order to prevent bacterial growth in the solution and to impart antifungal properties to the processed light-sensitive material.

Further, surfactants, optical brightening agents and hardeners may also be added. If stabilization is to be performed immediately without washing with water in the processing of the light-sensitive material, all of the known methods described in JP-A Sho. 57-8543, JP-A Sho. 58-14834, JP-A Sho. 60-220345, etc. may be employed.

In another preferred embodiment, chelating agents such as 1-hydroxyethylidene-1, 1-diphosphonic acid and ethylenediaminetetramethylenephosphonic acid, as well as magnesium and bismuth compounds may be used.

A rinsing solution may similarly be used as the washing or stabilizing solution subsequent to the desilvering process.

The preferred pH range for use in the washing or stabilizing step is from 4 to 10, more preferably from 5 to 8. The temperature can be set at various values depending upon such factors as the use and characteristics of the light-sensitive material, and the customary range is from 20° to 50° C., preferably from 25° to 45° C. The washing or stabilizing time can be set at any desired value, but a shorter time is desired from the viewpoint of shortening the overall processing time. The preferred range is from 10 to 60 seconds, more preferably from 15 to 45 seconds. The amount of replenishment is preferably small from the viewpoint of such factors as running cost, reduction in the amount of effluents and handling properties.

Stated more specifically, the preferred amount of replenishment is in range of 0.5–50 times, more preferably 3–40 times, the amount of carryover from a preceding bath per unit area of the light-sensitive material. Alternatively, the preferred amount of replenishment is 500 ml or less, more preferably 300 ml or less, per square meter of light-sensitive material. Replenishment may be performed either continuously or intermittently.

The solution used in the washing and/or stabilizing step may further be used in a preceding step. An example of this approach is such that an overflow of the washing water the amount of which is reduced by adopting a multi-step countercurrent system is admitted into the preceding bleach-fixing bath, which in turn is replenished with a concentrated solution, thereby reducing the amount of waste liquor.

Preferred embodiments of the present invention are described below with reference to the accompanying drawings. It should however be noted though that the present invention is by no means limited to those embodiments.

FIG. 1 shows a silver halide photographic color paper processor incorporating the apparatus of the present invention. In the processor, webs of color paper that have been exposed on the basis of a positive original are developed, bleach-fixed, washed with water and dried to form an image on the color paper. The color paper that can be processed with this processor (which color paper is sometimes hereinafter referred to as "light-sensitive materials") is a color photographic material that has on a support at least one layer of silver halide emulsion containing at least 95 mol % silver chloride, and it is color developed with a color developing solution containing an aromatic primary amino color developing agent.

The processor body contains in sequence a developing tank 4, a bleach-fixing tank 6, a washing zone 8 (composed of five tanks) and a drying zone (not shown). The exposed light-sensitive material 10, after being developed, bleach-fixed and washed, is dried and emerges from the processor body. The light-sensitive material is transported in such a manner that the emulsion-coated surface faces down when it is in a horizontal state.

The washing zone 8 preferably contains five tanks 8*a*–8*e* which are cascade-connected in such a way that the cleanliness of the washing water gradually decreases from the last tank to the first tank.

Each of the developing tank 4, bleach-fixing tank 6 and the washing zone 8 is adapted to be supplied with a replenisher in an amount that depends on the volume of the light-sensitive material 10 to be processed. The washing zone is replenished with fresh washing water in the last tank 8*e*.

The developing tank 4, bleach-fixing tank 6 and the washing zone 8 are provided with a plurality of transport rollers for transporting the light-sensitive material along the path shown in FIG. 1. Only part of the transport rollers is shown in FIG. 1.

In the developing tank 4 and the bleach-fixing tank 6, the light-sensitive material 10 is transported as it is submerged in the associated processing solutions. In the washing zone 8, the light-sensitive material 10 is transported as it is submerged in the washing water in the first tank 8*a* and the last tank 8*e*. In the intermediate tanks 8*b*–8*d*, the light-sensitive material 10 is transported above the level of the washing water, which is supplied to the light-sensitive material by means of pickup rollers 14. The light-sensitive material 10 that has been submerged in respective processing solutions is freed of those processing solutions by means of squeeze rollers 16, which can also work as transport rollers.

The developing tank 4, bleach-fixing tank 6, the first washing tank 8*a* and the last washing tank 8*e* are each provided with a process roller 18 constructed in accordance with the present invention.

Figure 2:
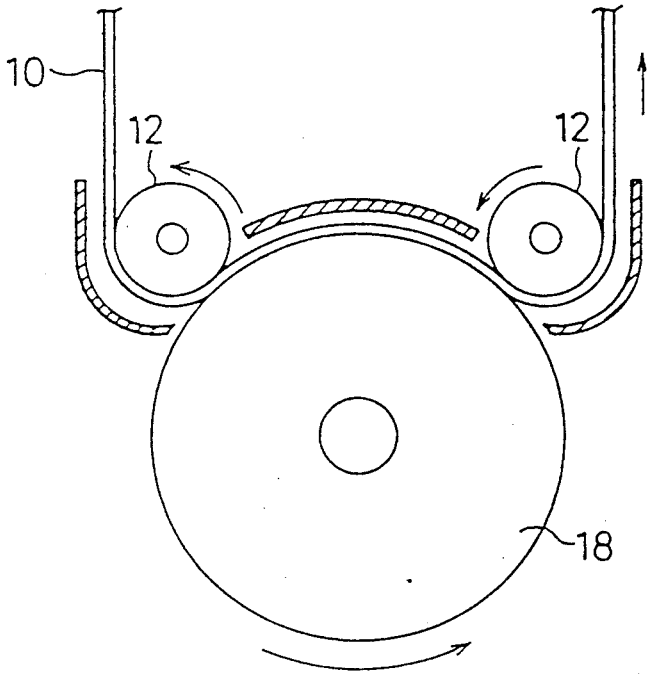
FIG. 2 is a diagrammatic section showing the area near the process roller of the present invention.

The process roller 18 is described below with reference to FIG. 2. The process roller 18 is rotatable by a drive device (not shown), and it is disposed in such a way that part of its peripheral surface is in engagement with the emulsion-coated surface of the light-sensitive material 10. The light-sensitive material 10 is transported by means of transport rollers 12 and guides as it engages the process roller 18 which, in the case shown, rotates in a direction opposite to the direction of transport of the light-sensitive material (counterclockwise in the case shown in FIG. 2).

Although the light-sensitive material engages the process roller 18 in each processing solution, a thin liquid film actually forms between the two members, which therefore are effectively prevented from making mutual contact. The light-sensitive material is processed with this liquid film. When the process roller 18 rotates at high speed, each processing solution is carried in a large volume into the space between the roller 18 and the light-sensitive material 10 under the action of the viscosity of that processing solution, and the resulting liquid film effectively processes the light-sensitive material 10.

The processing solution that took part in the processing of the light-sensitive material 10 will thereafter diffuse as the process roller 18 keeps rotating. Since fresh processing solution is continuously supplied into the space between the light-sensitive material 10 and the process roller 18 in response to the rotation of the roller 18, rapid replacement of the spent processing solution can be achieved on the surface of the light-sensitive material 10. Although the gap between the light-sensitive material 10 and the process roller 18 is only about 1 mm, since the process roller 18 rotates at high speed and in a direction opposite to the transport of the light-sensitive material, the spent processing solution is rapidly replaced by fresh solution on the surface of the light-sensitive material, which therefore can be effectively processed within a short time.

If the process roller 18 against which the light-sensitive material 10 is urged is rotated at a low speed, an effective liquid film will not form between the light-sensitive material 10 and the process roller 18 and the material is processed while making contact with the process roller 18. If the rotational speed of the process roller 18 is low, linear abrasion marks will develop in the light-sensitive material 10 in a direction parallel to its direction of transport irrespective of whether the direction of rotation of the process roller 18 is the same as or opposite to the direction of transport of the light-sensitive material 10. If the process roller 18 rotates in the same direction and at the same speed as the transport of the light-sensitive material 10, the light-sensitive material 10 will not slide against the process roller 18 in its own direction of transport, and hence no linear abrasion marks of the type described above will develop. In fact, however, the light-sensitive material 10 may move somewhat in the axial direction of the process roller 18 (i.e., it meanders), thereby developing abrasion marks in an indefinite direction. To prevent the occurrence of such abrasion marks, it is necessary to form an effective liquid film between the process roller 18 and the light-sensitive material 10.

The success of formation of an effective liquid film will depend upon various factors including the rotational speed of the process roller 18, its peripheral speed, its diameter and the transport speed of the light-sensitive material; however, the rotational speed of the process roller 18 is the most predominant factor. Therefore, the thickness of the liquid film to be formed can be controlled by merely adjusting the rotational speed of the process roller 18. If it is low, no effective liquid film will form, as already described above, and abrasion marks will develop in the light-sensitive material 10. However, if the process roller 18 is allowed to rotate at a high speed of at least 75 rpm, a large volume of the processing solution will be brought into the space between the light-sensitive material 10 and the process roller 18 under the action of viscosity, whereby a liquid film will form in a thickness greater than a predetermined level. The rotational speed of the process roller 18 is set at a value of at least 75 rpm, preferably at least 300 rpm. In the actual apparatus, the process roll 18 is preferably adjusted to rotate at speeds of 300–1500 rpm.

The process roller 18 preferably rotates at a peripheral speed of at least 5 m/min, more preferably at least 20 m/min, and most preferably at least 60 m/min. The preferred range of peripheral speeds that can be adopted without making the actual equipment unduly bulky is from 20 to 200 m/min.

The transport speed of the light-sensitive material 10 is preferably within the range of 0.2–20 cm/sec, more preferably 0.5–10 cm/sec, and most preferably 0.5–4 cm/sec.

The diameter of the process roller 18 is preferably in the range of 0.5–20 cm, more preferably 10.0–10 cm, and most preferably 10.0–7.0 cm.

The absolute value of the peripheral speed of the process roller is 18 preferably at least 1.5 times, more preferably at least 20–1000 times, the absolute value of the transport speed of the light-sensitive material. It is particularly preferred that the ratio of the two speeds on an absolute scale be in the range of 30–500, with the range of 60–300 being most preferred.

The process roller 18 is more advantageous for use in the case where the light-sensitive material 10 that has been wetted with a certain process solution is to be processed with another processing solution than in the case where the light-sensitive material 10 in a dry state is to be impregnated with a certain processing solution. The use of the process roller 18 is effective in such a case where the processing solution that has been deposited on the surface of the light-sensitive material or in the emulsion coating in a preceding treatment is to be removed by replacement with a fresh solution. Stated more specifically, the process roller 18 is particularly effective in the steps of bleach-fixing and washing with water in the case shown in FIG. 1.

In the case shown in FIG. 1, the process roller 18 is disposed in such a way that it is completely submerged in an associated processing solution and the light-sensitive material 10 is placed in engagement with the top surface of the process roller 18. It should, however, be noted that the process roller 18 need not be completely submerged in the processing solution and that it need only to be submerged at least partially in the processing solution as long as it can be brought into engagement with the light-sensitive material within the processing solution. It may be said that process roller 18 is submerged at least partially in the processing solution if the roller is traversed by the surface of the processing solution when the apparatus is shut down.

Figure 3:
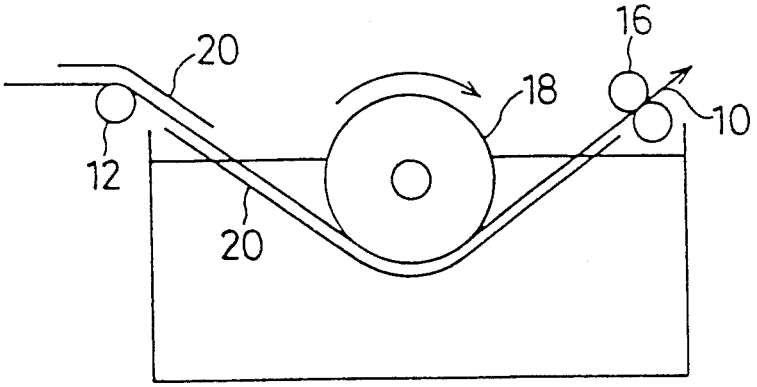
FIG. 3 is a diagrammatic view showing an example of the disposition of the process roller.

Various modifications of the disposition of the process roller 18 are described below. FIG. 3 shows the case where about one half of the process roller 18 is submerged in a processing solution. Only the lower part of the process roller 18 is submerged in the processing solution and the light-sensitive material 10 is transported with its emulsion-coated surface in engagement with the bottom surface of the process roller 18. The light-sensitive material 10 is transported through the processing solution by means of the transport roller 12, guide members 20 and squeeze rollers 16. The process roller 18 preferably rotates in a direction opposite to the transport of the light-sensitive material, whereby the spent processing solution is rapidly replaced with fresh solution on the surface of the light-sensitive material to achieve efficient processing of the material.

Figure 4:
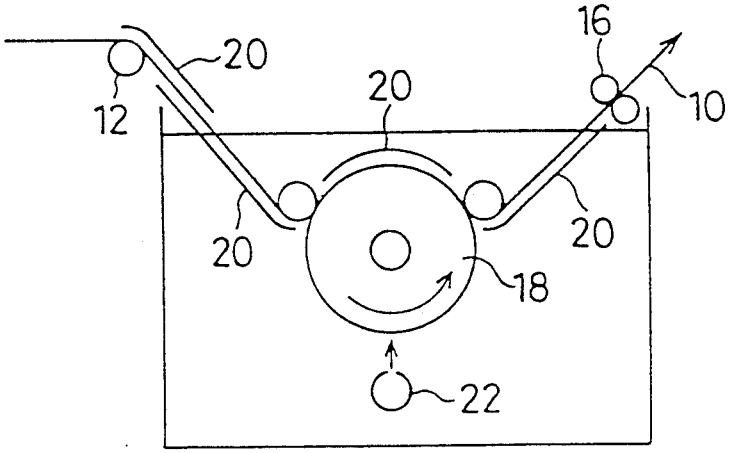
FIG. 4 is a diagrammatic view showing another example of the disposition of the process roller.

The process roller 18 shown in FIG. 4 is disposed in substantially the same manner as in the case shown in FIG. 1, except that a processing solution squirting member 22 is provided beneath the process roller 18 so that a processing solution is squirted at a high speed towards the processing roller 18 to produce a jet stream of the processing solution at the surface of the process roller 18. The squirting member 22 is composed of a pipe that has a plurality of orifices with a diameter of 0.5 mm formed in its surface at intervals of 5 mm along its length parallel to the axial direction of the process roller 18. The squirting member 22 is positioned 10 mm distant from the process roller 18. For the sake of convenience, the volume of jetted processing solution is expressed in terms of the jet volume per minute (10 liters) divided by the length of the process roller 18 (20 cm) to give a value 0.5 l/cm-min. The jet stream of processing solution produced at the surface of the process roller 18 works in such a way that the liquid film of the processing solution which has contributed to the processing of the light-sensitive material 10 is rapidly disrupted to diffuse away from the surface of the light-sensitive material 10. Accordingly, a liquid film of fresh processing solution is constantly formed between the process roller 18 and the light-sensitive material 10 to insure that the latter is processed in a rapid and efficient manner. The squirting member 22 may be provided not only for the types of process roller 18 that have been described above but also for those types which are to be described below.

Figure 5:
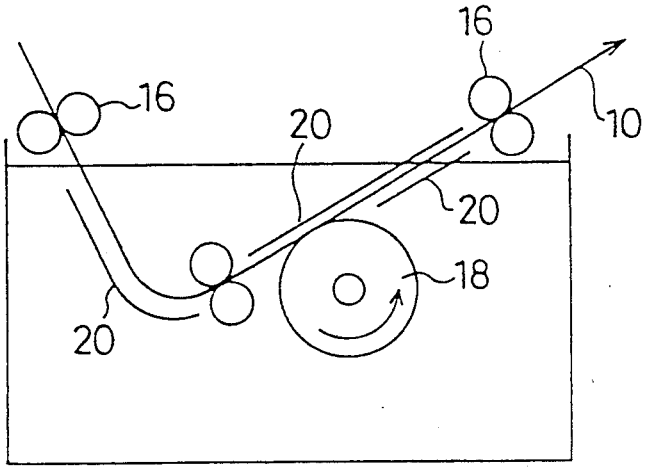
FIG. 5 is a diagrammatic view show still another example of the disposition of the process roller.

FIG. 5 shows another example of the disposition of the process roller 18. Above the liquid level of the processing solution are provided two pairs of squeeze rollers 16, one for holding and transporting the light-sensitive material 10 before it is submerged into the processing solution and the other for holding and transporting the same light-sensitive material 10 as it emerges from the processing solution. Further, another pair of squeeze rollers 16 is provided within the processing solution for holding and transporting the light-sensitive material 10 at a position upstream of the process roller 18. Guide members 20 are also provided within the processing solution. Since the light-sensitive material 10 is transported through the processing solution as it is held between squeeze rollers 16 submerged in the solution, the spent processing solution that has been deposited on the light-sensitive material 10 can be effectively removed and efficient replacement with a fresh solution is accomplished on the surface of the light-sensitive material 10 which is in engagement with the process roller 18.

In the embodiments described above, only one process roller unit is disposed in each processing tank, but, if desired, a plurality of process rollers 18, which may be of the same or a different kind, may be disposed consecutively in each tank.

Figure 6:
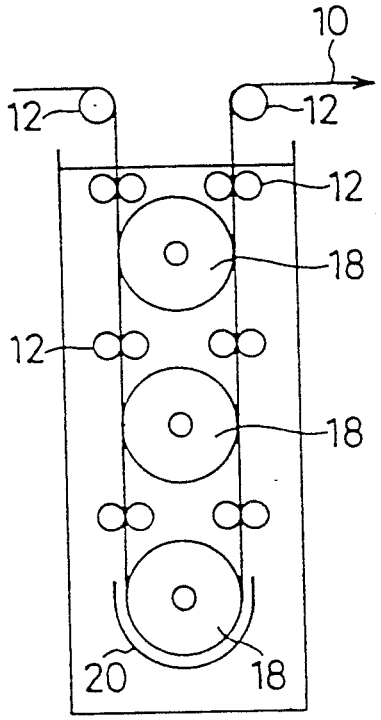
FIG. 6 is a diagrammatic view showing a further example of the disposition of the process roller.

FIG. 6 illustrates a case where three process rollers 18 are disposed in a processing tank. The process rollers 18 are disposed consecutively from top to bottom and from bottom to top. Preferably, all process rollers 18 are adapted to rotate in a direction opposite to the direction of transport of the light-sensitive material. The light-sensitive material 10 is transported by means of transport rollers 12, guide members 20, etc., with the emulsion-coated surface facing inward of the processing tank. The light-sensitive material 10 is transported in such a way that it engages some part, for instance, one half, of the peripheral surface of the bottom process roller 18. In this case, the process roller 18 is rotated at a speed of 75 rpm or more, which is much faster than the transport speed of the light-sensitive material, whereby the spent processing solution on the surface of the light-sensitive material 10 is replaced with a fresh solution in a rapid and efficient manner. The top and middle process rollers 18 make linear contact with the light-sensitive material 10, but the spent processing solution on the surface of the light-sensitive material 10 is similarly subjected to rapid and efficient replacement with a fresh solution.

Figure 7:
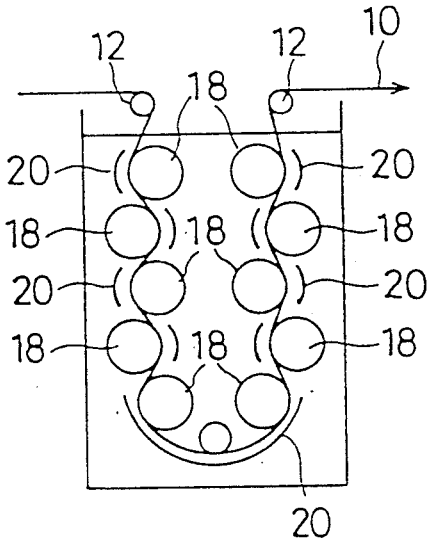
FIG. 7 is a diagrammatic view showing yet another example of the disposition of the process roller.

FIG. 7 shows the case in which a plurality of process rollers 18 are disposed in a zigzag manner along the transport path of the light-sensitive material. The light-sensitive material 10 is transported by transport roller 12 (only part of which is shown in FIG. 7) to be submerged in a processing solution as it is guided by guide members 20. The processing rollers 18 are preferably rotated in a direction opposite to the direction of transport of the light-sensitive material at a speed of 75 rpm or more, which is much faster than the transport speed of the light-sensitive material. Since the process rollers 18 are disposed on both sides of the light-sensitive material 10, the latter may be transported at any attitude whether the emulsion-coated surface faces inward or outward of the processing tank. If desired, the process roller 18 contacting the support side of the light-sensitive material 10 may be used with transport rollers that are rotated in the same direction as the transport of the light-sensitive material. Alternatively, those process rollers 18 may be replaced by transport rollers.

Figure 8:
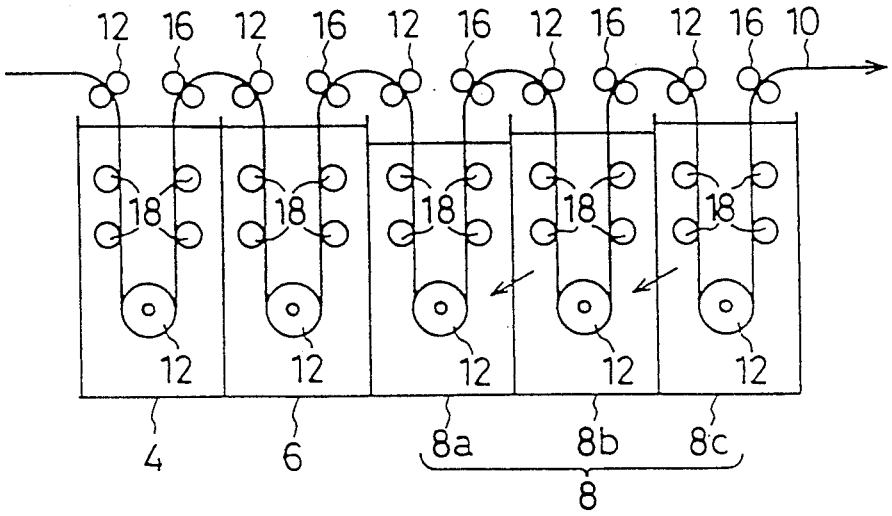
FIG. 8 is a diagrammatic view showing a modification of the construction of the process apparatus shown in FIG. 1; o

Various modifications of the processor are described below. FIG. 8 shows schematically a first modification of the processor. The processor includes a developing tank 4, a bleach-fixing tank 6 and a washing zone 8 (consisting of three cascade-connected tanks 8*a*–8*c*). In each of the tanks, a plurality of process rollers 18 are disposed along the transport path of the light-sensitive material 10, which is transported by transport roller 12 and squeeze rollers 16 in such a way that the emulsion-coated surface is in tangential contact with the individual process roller 18. Each of the process rollers 18 is preferably rotated in a direction opposite to the transport of the light-sensitive material.

Figure 9:
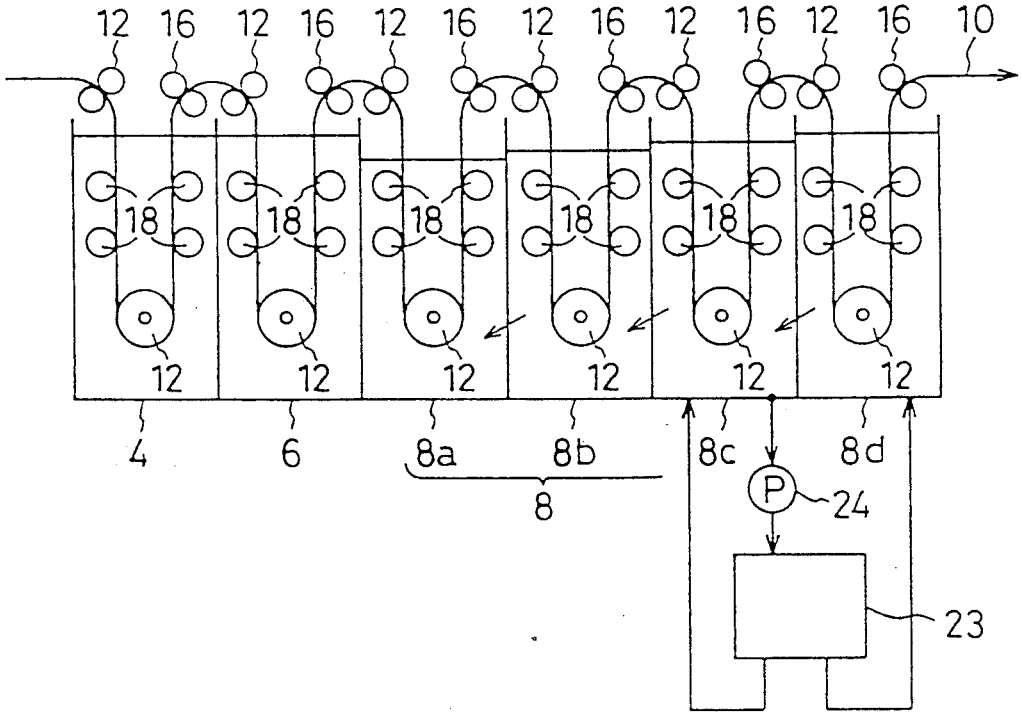
FIG. 9 is a diagrammatic view showing another modification of the same processing apparatus.

FIG. 9 shows schematically a second modification of the processor. Since this modification is essentially the same as what is shown in FIG. 8, only the differences are described below. The washing zone 8 consists of four cascade-connected tanks 8*a*–8*d*, and a reverse osmotic membrane 23 is also provided for one of the washing tanks 8. By subjecting the washing water to reverse osmosis through the membrane 23, the unwanted components of the washing water (especially the fixing and bleach-fixing components) are sufficiently removed to reduce their possible adverse effects on the light-sensitive material 10. The water in the third washing tank 8*c* is forced into the reverse osmotic membrane 23 by means of a pump 24, and the permeate from the membrane 23 is supplied into the fourth washing tank 8*d* while the concentrated water which has not passed through the membrane 23 is returned to the third washing tank 8*c*.

Figure 10:
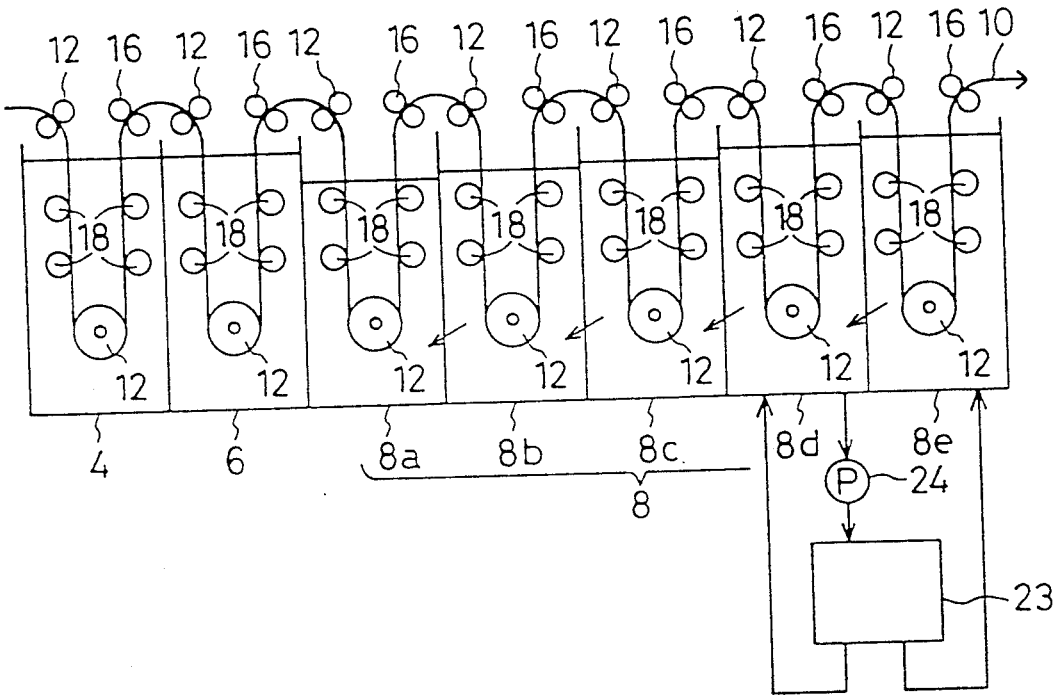
FIG. 10 is a diagrammatic view showing still another modification of the same processing apparatus.

FIG. 10 shows schematically still another modification of the processor. This modification is similar in construction to the case shown in FIG. 9 but differs in that the washing zone consists of five cascade-connected tanks 8*a*–8*e*. The water in the fourth washing tank 8*d* is forced into the reverse osmotic membrane 23 by means of the pump 24 and the permeate from the membrane 23 is supplied into the fifth washing tank 8*e* while the concentrated water which has not passed through the membrane 23 is returned to the fourth washing tank 8*d*.

Figure 11:
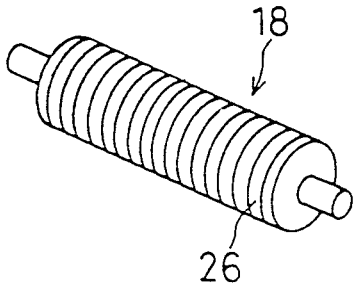
FIGS. 11(*a*)–11(*f*) are perspective views showing various specific examples of the process rOller of the present invention.
Figure 11:
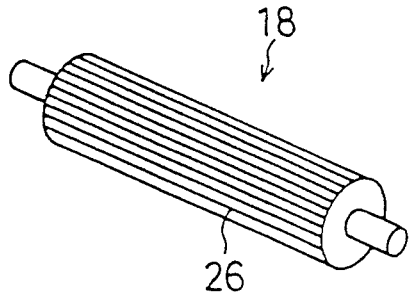
Figure 11:
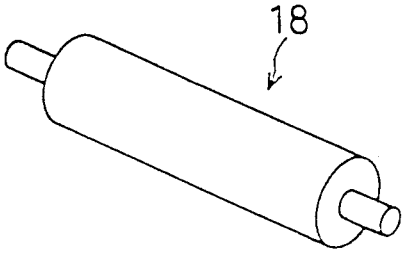
Figure 11:
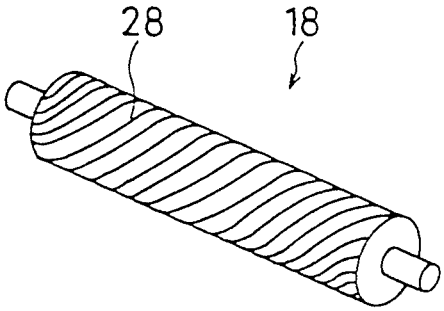
Figure 11:
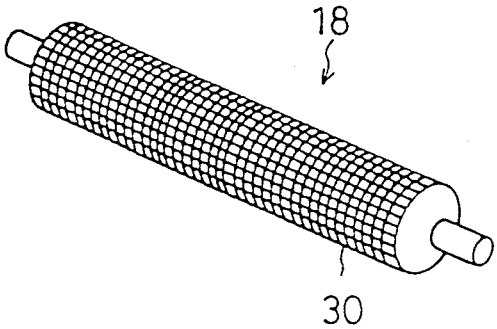
Figure 11:
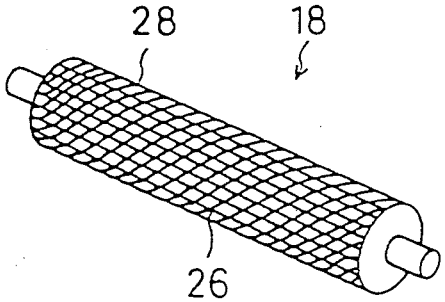

FIGS. 11(*a*) to 11(*f*) show various specific forms of the process roller 18. FIG. 11(*a*) is a perspective view of process roller 18 having grooves 26 formed in it peripheral surface in the circumferential direction. Instead of cutting grooves 26, a wire may be wound around the process roller 18 to form grooves 26 between adjacent turns of the wire. FIG. 11(*b*) is a perspective view of a process roller 18 having grooves 26 formed in its peripheral surface in the axial direction. The grooves are preferably spaced at intervals of no more than 2 mm. FIG. 11(*c*) is a perspective view of a process roller 18 having a flat peripheral surface. FIG. 11(*d*) is a perspective view of a process roller 18 having spiral grooves 28 in its peripheral surface. Only one spiral groove 28 may be provided, but preferably five or more spiral grooves are provided. The angle of inclination of the spiral grooves 28 with respect to the circumferential direction is preferably at least 5 degrees.

FIG. 11(*e*) is a perspective view of a process roller 18, which is a roller for gravure printing, having triangular, square, rectangular or otherwise shaped ridges and grooves 30 in its peripheral surface. FIG. 11(*f*) is a perspective view of a process roller 18 having both spiral grooves 28 and axial grooves 26 formed in its peripheral surface. The axial grooves 26 help improve the ability of the roller 18 to supply the processing solution, whereas the spiral grooves 28 contribute to enhanced disposal of the waste liquor.

In the case where the process roller 18 is partly submerged in a processing solution and partly in contact with ambient air, the fast rotating roller 18 will increase the chance of the processing solution becoming atomized to splash over the light-sensitive material so that it will soon evaporate. This evaporation of the processing solution is accelerated if it is held at high temperature with a view to achieving rapid processing of the light-sensitive material. Hence, the space above the processing solution is preferably rendered substantially airtight in order to prevent its evaporation. In order to make the space above the processing solution airtight, the space may be covered with an airtight lid, or a floating lid may be provided to cover the surface of the processing solution.

In the case of using an airtight lid, it is required to provide not only air tightness but also a passageway for the transport of the light-sensitive material 10, and hence a shutter arrangement may be provided in such a way that a slit is closed or opened by means of a pair of flexible blades that contact each other at their free ends. The construction of the shutter arrangement is no way limited to this case alone and another type of shutter as described in JP-A Hei. 2-161431 may be employed. In any event, the space above the processing solution is rendered substantially airtight, whereby the evaporation or oxidation of the processing solution will not proceed so rapidly as to cause its deterioration.

EXAMPLES

The following examples are provided for the purpose of further illustrating the present invention, but are in no way to be taken as limiting.

Example 1

Color papers ("Fuji Color Paper Super FA-II" produced by Fuji Photo Film Co., Ltd.) were used as samples of light-sensitive material.

Using a sensitometer (Type FWH produced by Fuji Photo Film Co., Ltd., color temperature of the light source, 3,200° K.), the samples were given multi-level exposure through a sensitometric color separating filter. The exposure was continued for 0.1 seconds to provide 250 CMS.

The exposed sample were processed with a processor constructed as shown in FIG. 1. In the processor, the light-sensitive material was transported at a speed of 1.4 cm/sec. the process rollers were of the type (d) shown in FIG. 11, and they each had a diameter of 3.0 cm, with spiral grooves semi-circular in cross section having a width of 2 mm and being spaced at intervals of 2 mm inclined at an angle of approximately 10 degrees with respect to the circumferential direction of the roller. The process rollers were rotated at 1000 rpm in a direction opposite to the transport of the light-sensitive material. The processing scheme was as follows:

| Steps | Temperature (°C.) | Time (sec.) | Replenisher (ml) | Tank Capacity (l) |
|---|---|---|---|---|
| Color development | 42 | 20 | 80 | 0.7 |
| Bleach-fixing | 40 | 10 | 60 | 0.7 |
| Rinsing (1) | 45 | 5 | — | 0.5 |
| Rinsing (2) | 45 | 5 | — | 0.5 |
| Rinsing (3) | 45 | 5 | — | 0.5 |
| Rinsing (4) | 45 | 5 | — | 0.5 |
| Rinsing (5) | 45 | 5 | 100 | 0.5 |
| Drying | 70-80 | 10 | — | — |

Note: The amounts of replenishers are calculated per square meter of the light-sensitive material.

Rinsing was performed by a five-tank countercurrent method in which the solution for rinsing in step (5) was allowed to flow back successively through rinsing steps (4), (3) and (2) to step 1.

The individual processing solutions had the following compositions:

| Color Developing Solution | Tank Solution | Replenisher |
|---|---|---|
| Water | 800 ml | 800 ml |
| 1-hydroxyethylidene-1,1-diphosphonic acid | 0.5 g | 0.7 g |
| Diethylenetriaminepenta-acetic acid | 1.0 g | 1.4 g |
| N,N,N-trismethylenephosphonic acid | 1.5 g | 2.0 g |
| Potassium bromide | 0.01 g | — |
| Triethanolamine | 8.1 g | 8.1 g |
| Sodium sulfite | 0.14 g | 0.14 g |
| Potassium chloride | 8.2 g | — |
| Potassium carbonate | 18.7 g | 37 g |
| N-Ethyl-N-(3-hydroxypropyl)-3-methyl-4-aminoaniline diparatoluenesulfonic acid salt | 12.8 g | 27.8 g |
| N,N-Bis(2-sulfoethyl)hydroxylamine | 8.5 g | 11.0 g |
| Optical brightening agent ("WHITEX 4B" of Sumitomo Chemical Co., Ltd.) | 1.0 g | 1.0 g |
| Water | to make 1,000 ml | to make 1,000 ml |
| pH (at 25° C.) | 10.05 | 10.95 |

| Bleach-fixing solution | Tank Solution | Replenisher |
|---|---|---|
| Water | 400 ml | 400 ml |
| Ammonium thiosulfate (70% sol.) | 100 ml | 250 ml |
| Ammonium sulfite | 40 g | 100 g |
| Ethylenediaminetetraacetic acid iron (III) ammonium dihydrate | 73 g | 183 g |
| Ethylenediaminetetraacetic acid | 3.4 g | 8.5 g |
| Ammonium bromide | 20 g | 50 g |
| Nitric acid (67% sol.) | 9.6 g | 24 g |
| Water | to make 1,000 ml | to make 1,000 ml |
| pH (at 25° C.) | 5.80 | 5.10 |

The rinsing solution was the same for both the tank solution and the replenisher.

Ion-exchanged water was employed containing less than 3 ppm of Ca and Na.

A comparative sample was developed and bleached-fixed as in Example 1 and immediately subjected to washing with water on Mini-Lab FA (product of Fuji Photo Film Co., Ltd.) using its washing zone for the standard time of CP 40FA (90 seconds).

The image on the samples that were processed rapidly using the apparatus of the present invention was practically complete and had the same quality as the comparison. The processed samples were left at 80° C. for seven days at 70% r.h., but the level of staining was in no way different from the comparison subjected to the standard procedure of washing with Mini-Lab FA. It was therefore clear that the light-sensitive material was cleaned satisfactorily using the apparatus of the present invention.

Example 2

The procedure of Example 1 was repeated except for the following design changes. The processor used was constructed as shown in FIG. 8. The light-sensitive material was transported at a speed of 1.3 cm/sec. Process rollers were of type (b) shown in FIG. 11, and they each had a diameter of 2.0 cm, with straight grooves semi-circular in cross section having a width of 2 mm spaced at intervals of 2 mm. The process rollers were rotated at 800 rpm in a direction opposite to the direction of transport of the light-sensitive material.

The comparison was a sample that was subject to standard processing with Mini-Lab FA (product of Fuji Photo Film Co., Ltd.) using its washing zone (total of the washing times in the three tanks was 90 seconds).

The samples processed with the apparatus of the present invention were in no way different from the comparison of standard processing with the Mini-Lab in terms of either the whiteness of the background of the image or an increase in staining that occurred when the processed samples with complete image were left at 8° C. at 70% r.h. In other words, the samples processed in accordance with the present invention achieved commercially acceptable levels of performance.

Example 3

A processor constructed as shown in FIG. 9 was used. The light-sensitive material was transported at a speed of 1.3 cm/sec.

Process rollers were of type (b) shown in FIG. 11, each having a diameter of 2 mm, with straight grooves semi-circular in cross section having a width of 2 mm and being spaced at intervals of 2 mm.

The process rollers were rotated at 850 rpm in a direction opposite to the transport of the light-sensitive material.

The operating procedure was the same as in Example 2 except for the following design changes:

Rinsing step (4) was added, and rinsing was performed by a four-tank countercurrent method in which the solution for rinsing in step (4) was allowed to flow back successively through rinsing steps (3) and (2) to step (1). The staying time in each rinse tank was adjusted to 5 seconds. The replenisher was supplied for the rinsing step (4) rather than step (3). As a reverse osmotic membrane, a spiral RO module element DRA-80 of Daicel Chemical Industries, Ltd., (polysulfone-base composite membrane having an effective membrane area of 1.1 $m^2$) was used, and it was installed in a plastic vessel Model PV-0321 of Daicel Chemical Industries, Ltd.

In operating the reverse osmotic membrane system shown in FIG. 9, the water in the third rinse tank was pumped to the reverse osmotic membrane at a pressure of 7 $kg/cm^2$ and at a flow rate of 1.5 □/min, and the permeate was supplied into the fourth rinse tank, whereas the concentrated water was returned to the third rinse tank.

As a comparison, processing was done as in Example 1 using the same apparatus as shown in FIG. 7, except for the washing step which was performed by immersing the light-sensitive material in the washing water in four tanks, with the total washing time being 20 seconds (5 seconds for each tank).

The yellow density of the white background of each of the images produced in the processed samples is shown below:

| Sample | Yellow Density of White Background |
|---|---|
| Example 3 | 0.11 |
| Comparison | 0.15 |

This data shows that the apparatus of the present invention achieved more efficient cleaning than the comparison.

Example 4

The processor used in Example 4 was of the same type as shown in FIG. 9 (which was also used in Example 3). The light-sensitive material was transported at a speed of 1.3 cm/sec. The processor rollers were of the type (d) shown in FIG. 11, and they each had a diameter of 1.2 cm, with spiral grooves semi-circular in cross section having a width of 2 mm spaced at intervals of 2 mm. The process rollers were inclined at an angle of about 10 degrees with respect to the circumferential direction of the roller. In Example 4, processing was done with the process rollers rotated at varying speeds to check for the occurrence of abrasion marks in the light-sensitive material. The results are shown in the following table:

| Rotational speed of process roller (rpm) | Abrasion marks in the transport direction | Abrasion marks in directions other than transport direction |
|---|---|---|
| 40 | X | X |
| 50 | Δ | Δ |
| 75 | ○ | ○ |
| 130 | ○ | ○ |
| 250 | ○ | ○ |
| 1000 | ○ | ○ |

X: abrasion marks occurred
Δ: slight abrasion marks occurred
○: no abrasion marks occurred The abrasion resistance of the light-sensitive material seems to correlate with the volume of processing solutions held between the light-sensitive material and the process roller. When the process rollers were rotated at speed of 75 rpm and above, liquid films of processing solutions formed between the light-sensitive material and the process rollers to prevent the occurrence of abrasion marks. It was therefore demonstrated that satisfactory processing of the light-sensitive material could be accomplished while preventing the occurrence of abrasion marks in the material by permitting the process rollers to be rotate at a speed of at least 75 rpm.

In accordance with the present invention, a light-sensitive material is transported as it is placed in engagement with the peripheral surface of that part of a process roller which is submerged in a processing solution and the process roller is rotated at a speed of at least 75 rpm. Because of this arrangement, a predetermined amount of the processing solution is constantly supplied into the space between the light-sensitive material and the process roller and, at the same time, the processing solution is rapidly replaced with a fresh solution at the surface of the light-sensitive material, whereby the light-sensitive material can be efficiently processed without damage. In addition, efficient processing can be accomplished with a small amount of the processing solution, so that the number of the necessary machine components is sufficiently reduced to enable the construction of a simple and compact processing apparatus that features easy maintenance.

What is claimed is:

1. An apparatus for processing a light-sensitive material having an emulsion-coated surface, comprising: a tank containing a processing solution; a rotatable process roller, said process roller being at least partially submersed in said processing solution, said process roller being rotated at a rotational speed of at least 75 rpm with the absolute value of a peripheral speed of said roller being greater than a transport speed of said light-sensitive material; and means for transporting said light-sensitive material with said emulsion-coated surface in engagement with a peripheral surface of a portion of said process roller immersed in said processing solution, said light-sensitive material being processed while in engagement with said process roller.

2. The apparatus of claim 1, wherein said rotational speed is at least 300 rpm

3. The apparatus of claim 1, wherein said rotational speed is in a range of 300-1500 rpm.

4. The apparatus of claim 1, wherein said absolute value of said peripheral speed is at least 1.5 times said transport speed.

5. The apparatus of claim 1, wherein a ratio of said absolute value of said peripheral speed to said transport speed is in a range of 200-1000.

6. The apparatus of claim 1, wherein a ratio of said absolute value of said peripheral speed to said transport speed is in a range of 30-500.

7. The apparatus of claim 1, wherein a ratio of said absolute value of said peripheral speed to said transport speed a range of 60-300.

8. The apparatus of claim 1, wherein said peripheral speed is at least 5 m/min.

9. The apparatus of claim 1, wherein said peripheral speed is at least 20 m/min

10. The apparatus of claim 1, wherein said peripheral speed is at least 60 m/min.

11. The apparatus of claim 1, wherein a diameter of said process roller is in a range of 0.5-20 cm.

12. The apparatus of claim 1, wherein a diameter of said process roller is in a range of 1.0-10 cm.

13. The apparatus of claim 1, wherein a diameter of said process roller is in a range of 1.0-7.0 cm.

14. The apparatus of claim 1, wherein said transport speed is in a range of 0.2-20 cm/sec.

15. The apparatus of claim 1, wherein said transport speed is in a range of 0.5-10 cm/sec.

16. The apparatus of claim 1, wherein said transport speed is in a range of 0.5-4 cm/sec.

17. The apparatus of claim 1, wherein said process roller has grooves and ridges formed on said peripheral surface.

18. The apparatus of claim 17, wherein a depth of said grooves and a height of said ridges is in a range of 0.1-5 mm.

19. The apparatus of claim 1, wherein said process roller comprises a wire rod having a wire wound in spiral form on said peripheral surface.

20. The apparatus of claim 19 wherein said wire has a diameter in a range of 1-5 mm.

21. The apparatus of claim 1, further comprising means for rendering a space above said processing solution in said tank airtight.

22. The apparatus of claim 1, wherein a plurality of said process rollers are provided in said tank.

23. An apparatus for processing a light-sensitive material having an emulsion-coated surface, comprising: a tank containing a cleaning solution; a rotatable process roller, said process roller being at least partially submersed in said cleaning solution, said process roller being rotated at a rotational speed of at least 75 rpm; and means for transporting said light-sensitive material with said emulsion-coated surface in engagement with a peripheral surface of a portion of said process roller immersed in said cleaning solution, said light-sensitive material being cleaned while in engagement with said process roller.

24. The apparatus of claim 23, wherein said rotational speed is at least 300 rpm.

25. The apparatus of claim 23, wherein said rotational speed is in a range of 300-1500 rpm.

26. The apparatus of claim 23, wherein the absolute value of a peripheral speed of said process roller is at least 1.5 times a transport speed of said light sensitive material.

27. The apparatus of claim 23, wherein a ratio of the absolute value of a peripheral speed of said process roller to a transport speed of said light-sensitive material is in a range of 200-1000.

28. The apparatus of claim 23, wherein a ratio of the absolute value of a peripheral speed of said process roller to a transport speed of said light-sensitive material is in a range of 30-500.

29. The apparatus of claim 23, wherein a ratio of the absolute value of a peripheral speed of said process roller to a transport speed of said light-sensitive material is in a range of 60-300.

30. The apparatus of claim 23, wherein a peripheral speed of said process roller is at least 5 m/min.

31. The apparatus of claim 23, wherein a peripheral speed of said process roller is at least 20 m/min.

32. The apparatus of claim 23, wherein a peripheral speed of said process roller is at least 60 m/min.

33. The apparatus of claim 23, wherein a diameter of said process roller is in a range of 0.5-20 cm.

34. The apparatus of claim 23, wherein a diameter of said process roller is in a range of 1.0-10 cm.

35. The apparatus of claim 23, wherein a diameter of said process roller is in a range of 1.0-7.0 cm.

36. The apparatus of claim 23, wherein a transport speed of said light-sensitive material is in a range of 0.2-20 cm/sec.

37. The apparatus of claim 23, wherein a transport speed of said light-sensitive material is in a range of 0.5-10 cm/sec.

38. The apparatus of claim 23, wherein a transport speed of said light-sensitive material is in a range of 0.5-4 cm/sec.

39. The apparatus of claim 23, wherein said process roller has grooves and ridges formed on said peripheral surface.

40. The apparatus of claim 39, wherein a depth of said grooves and a height of said ridges is in a range of 0.1-5 mm.

41. The apparatus of claim 23, wherein said process roller comprises a wire rod having a wire wound in spiral form on said peripheral surface.

42. The apparatus of claim 41 wherein said wire has a diameter in a range of 1-5 mm.

43. The apparatus of claim 23, further comprising means for rendering a space above said processing solution in said tank airtight.

44. The apparatus of claim 23, wherein a plurality of said process rollers are provided in said tank.

* * * * *